US011479391B2

(12) United States Patent
Vachon

(10) Patent No.: US 11,479,391 B2
(45) Date of Patent: Oct. 25, 2022

(54) VENTED SPOUT FOR A LIQUID STORAGE CONTAINER

(71) Applicant: LE GROUPE DSD INC., Thetford Mines (CA)

(72) Inventor: Leandre Vachon, Thetford Mines (CA)

(73) Assignee: LE GROUPE DSD INC., Thetford Mines (CA)

( * ) Notice: Subject to any disclaimer, the term of this patent is extended or adjusted under 35 U.S.C. 154(b) by 0 days.

(21) Appl. No.: 17/072,768

(22) Filed: Oct. 16, 2020

(65) Prior Publication Data

US 2021/0031989 A1 Feb. 4, 2021

Related U.S. Application Data

(63) Continuation of application No. PCT/CA2019/050468, filed on Apr. 16, 2019.

(30) Foreign Application Priority Data

Apr. 16, 2018 (CA) ..... CA 3001597

(51) Int. Cl.
*B65D 47/06* (2006.01)
*B65D 47/32* (2006.01)
(Continued)

(52) U.S. Cl.
CPC ..... *B65D 47/32* (2013.01); *B65D 47/12* (2013.01); *B65D 50/06* (2013.01)

(58) Field of Classification Search
CPC ..... B65D 2251/1033; B65D 2251/205; B65D 2251/1066; B65D 2547/066;
(Continued)

(56) References Cited

U.S. PATENT DOCUMENTS 886,237 A * 4/1908 Murtha ..... B67C 11/063 141/335
2,723,793 A 11/1955 Hubbell
(Continued)

FOREIGN PATENT DOCUMENTS

CA 2545907 A1 11/2007
CA 2546129 A1 11/2007
(Continued)

OTHER PUBLICATIONS

Machine translation in English of EP3067312B1.
(Continued)

*Primary Examiner* — Charles P. Cheyney
(74) *Attorney, Agent, or Firm* — Ipaxio S.E.N.C.

(57) ABSTRACT

The spout includes a first member and a second member. The first member includes an elongated and generally tubular first main body having at least two longitudinally extending internal passageways, one being an air duct and the other being a liquid duct. The air duct ends with at least one constricted opening through which the air circuit exits the air duct. A valve is provided at the rear end of the first main body and is made integral therewith. The valve engages a valve seat provided at the rear end of an inner conduit positioned inside the second member and in which a rear section of the first main body is slidingly movable. The spout may be provided with a child-resistant closure (CRC) device.

20 Claims, 23 Drawing Sheets

(51) Int. Cl.
*B65D 47/12* (2006.01)
*B65D 50/06* (2006.01)

(58) Field of Classification Search
CPC ..... B65D 47/061; B65D 47/06; B65D 47/32; B65D 25/44; B67D 7/005; B67D 7/04
USPC ..... 222/484, 511, 518, 522, 559
See application file for complete search history.

(56) References Cited

U.S. PATENT DOCUMENTS

| | | | | |
|---|---|---|---|---|
| 2,822,832 | A | 2/1958 | Craw | |
| 2,841,313 | A | 7/1958 | Beall, Jr. | |
| 3,074,444 | A | 1/1963 | Hawksford | |
| 3,434,513 | A | 3/1969 | O'Bannon | |
| 3,540,402 | A | 11/1970 | Kocher | |
| 3,606,096 | A * | 9/1971 | Campbell | B67D 7/005 222/479 |
| 3,734,149 | A | 5/1973 | Hansel | |
| 3,834,594 | A | 9/1974 | Schiemann | |
| 3,967,660 | A | 7/1976 | Russell | |
| 3,987,943 | A | 10/1976 | Richmond, Jr. | |
| 3,994,323 | A | 11/1976 | Takahata et al. | |
| 4,053,002 | A | 10/1977 | Ludlow | |
| 4,129,236 | A | 12/1978 | Wrycraft et al. | |
| 4,213,488 | A | 7/1980 | Pyle | |
| 4,478,242 | A | 10/1984 | Bond | |
| 4,564,132 | A | 1/1986 | Lloyd-Davies | |
| 4,667,710 | A | 5/1987 | Wu | |
| 4,746,036 | A | 5/1988 | Messner | |
| 4,796,678 | A | 1/1989 | Motohashi et al. | |
| D303,634 | S | 9/1989 | Vachon | |
| 4,871,096 | A | 10/1989 | Horian | |
| 4,924,921 | A | 5/1990 | Simmel et al. | |
| 4,958,668 | A | 9/1990 | Vachon | |
| 4,982,881 | A | 1/1991 | Amrein | |
| 5,042,698 | A | 8/1991 | Fessell | |
| 5,076,333 | A | 12/1991 | Law | |
| 5,092,497 | A | 3/1992 | Toedter | |
| 5,107,909 | A | 4/1992 | Donovan | |
| 5,228,487 | A | 7/1993 | Thiermann et al. | |
| 5,249,611 | A | 10/1993 | Law | |
| 5,255,713 | A | 10/1993 | Scholle et al. | |
| 5,327,945 | A | 7/1994 | Simpson et al. | |
| 5,406,994 | A | 4/1995 | Mitchell et al. | |
| 5,419,378 | A | 5/1995 | Law | |
| 5,450,884 | A | 9/1995 | Shih et al. | |
| 5,507,328 | A | 4/1996 | Donovan | |
| 5,560,522 | A | 10/1996 | Clark | |
| 5,603,364 | A | 2/1997 | Kerssies | |
| 5,628,352 | A | 5/1997 | Gracyalny et al. | |
| 5,711,355 | A | 1/1998 | Kowalczyk | |
| 5,762,117 | A | 6/1998 | Law | |
| 5,961,001 | A | 10/1999 | Davis et al. | |
| 5,988,458 | A | 11/1999 | Messner | |
| 6,155,464 | A | 12/2000 | Vachon | |
| 6,227,419 | B1 | 5/2001 | Raboin | |
| 6,401,752 | B1 | 6/2002 | Blackbourn et al. | |
| 6,435,380 | B1 * | 8/2002 | Raboin | B67D 7/005 141/292 |
| 6,478,058 | B1 | 11/2002 | Pears | |
| 6,581,851 | B1 | 6/2003 | Murphy | |
| 6,722,535 | B1 | 4/2004 | Flach | |
| 6,742,680 | B2 | 6/2004 | Friedman | |
| 6,889,732 | B2 | 5/2005 | Allen | |
| 6,968,875 | B2 | 11/2005 | Nielsen | |
| 7,013,936 | B2 | 3/2006 | Schliemann et al. | |
| 7,513,395 | B2 | 4/2009 | Labinski et al. | |
| 7,543,723 | B2 | 6/2009 | Wilford et al. | |
| 7,621,304 | B2 | 11/2009 | Nielsen | |
| 8,038,035 | B2 | 10/2011 | Forbis | |
| 8,113,239 | B2 | 2/2012 | Richards et al. | |
| 8,201,595 | B2 | 6/2012 | Trippi, Jr. | |
| 8,403,185 | B2 * | 3/2013 | Vachon | B67D 7/005 222/484 |
| 8,561,858 | B2 * | 10/2013 | Vachon | B67D 7/005 222/484 |
| 8,567,646 | B1 | 10/2013 | Cray | |
| 8,616,419 | B2 | 12/2013 | Slack | |
| 8,800,826 | B2 * | 8/2014 | Forbis | B67D 7/005 222/484 |
| 9,493,280 | B2 * | 11/2016 | Wilkinson | B65D 25/48 |
| 9,783,404 | B2 | 10/2017 | Van Gelder et al. | |
| 10,196,187 | B2 | 2/2019 | Hingorani | |
| 10,308,405 | B2 | 6/2019 | Gaikwad et al. | |
| 10,427,843 | B2 | 10/2019 | Julien et al. | |
| 10,472,137 | B2 | 11/2019 | Vachon | |
| 10,683,148 | B2 | 6/2020 | Adam et al. | |
| 2012/0118431 | A1 | 5/2012 | Dickie | |
| 2014/0097210 | A1 | 4/2014 | Wright | |
| 2017/0327281 | A1 | 11/2017 | Cross | |
| 2018/0037379 | A1 * | 2/2018 | Adam | B67D 7/04 |
| 2019/0093823 | A1 * | 3/2019 | Scott | B67D 7/78 |

FOREIGN PATENT DOCUMENTS

| | | | |
|---|---|---|---|
| CN | 203558842 | U | 4/2014 |
| EP | 0112938 | A2 | 7/1984 |
| EP | 3067312 | B1 | 8/2017 |
| JP | 11070957 | A | 3/1999 |
| JP | 2005041541 | A | 2/2005 |
| WO | 2015052507 | A1 | 4/2015 |
| WO | 2019200469 | A1 | 10/2019 |
| WO | 2020124272 | A1 | 6/2020 |
| WO | 2020154792 | A1 | 8/2020 |

OTHER PUBLICATIONS

Machine translation in English of CN203558842.
Machine translation in English of JP11070957.
Machine translation in English of JP2005041541.

* cited by examiner

VENTED SPOUT FOR A LIQUID STORAGE CONTAINER

CROSS REFERENCE TO PRIOR APPLICATIONS

The present case is a continuation of PCT Application No. PCT/CA2019/050468 filed 16 Apr. 2019. PCT/CA2019/050468 claims the benefits of Canadian patent application No. 3,001,597 filed 16 Apr. 2018. The entire contents of these prior patent applications are hereby incorporated by reference.

TECHNICAL FIELD

The technical field relates generally to vented spouts for liquid-storage containers.

BACKGROUND

Many different kinds of spouts have been proposed over the years for use during a gravity transfer of liquids from a container into a receptacle, such receptacle being for instance another container or a tank, to name just a few examples. Some of these spouts include an air vent to admit air inside the container through the spouts when the liquid flows, and also a shutoff valve to control the liquid flow during the transfer. Examples can be found, for instance, in U.S. Pat. Nos. 8,403,185 and 8,561,858.

While most of the prior arrangements have been generally useful and convenient on different aspects, there are still some limitations and challenges remaining in this technical area for which further improvements would be highly desirable.

SUMMARY

In one aspect, there is provided a vented pouring spout for a liquid-storage container, the spout including: a first member including: an elongated and generally tubular first main body having a front section and a rear section, the first main body having at least two longitudinally extending internal passageways, one being an air duct through which an air circuit passes when air enters the container and the other being a liquid duct through which a liquid circuit passes when the liquid flows out of the container, the air duct being generally positioned along a top side of the first main body and being smaller in cross section than that of the liquid duct, the air duct extending inside the first main body up to at least one constricted opening that is generally positioned at a rear end of the first main body, from which the air circuit exits the air duct, the air duct being segregated from the liquid duct; and a valve provided at the rear end of the first main body, the valve having a rear section and a front tapered section, the front tapered section extending between the rear section of the first main body and the rear section of the valve, the front section being adjacent to an inlet of the liquid duct and to the at least one constricted opening; a second member including: an elongated second main body having a straight tubular inner conduit inside which the rear section of the first main body is slidingly movable, the inner conduit having a rear end defining a valve seat that is engaged by the valve in a closed position to block the air circuit and the liquid circuit, the valve being out of engagement with the valve seat when the valve is in a fully opened position; and an outer rim portion projecting out from the second main body and spaced apart from a rearmost end of the spout, the outer rim portion delimiting a base of the spout from a forward section of the spout; an inner gasket provided between the first member and the second member to seal in an airtight manner an intervening peripheral space between the rear section of the first main body and the inner conduit of the second main body; and a biasing element positioned between the first member and the second member to urge the valve towards the closed position.

In another aspect, there is provided a vented spout as shown, described and/or suggested herein.

Further details on these aspects as well as other aspects of the proposed concept will be apparent from the following detailed description and the appended figures.

DETAILED DESCRIPTION

Figure 1:
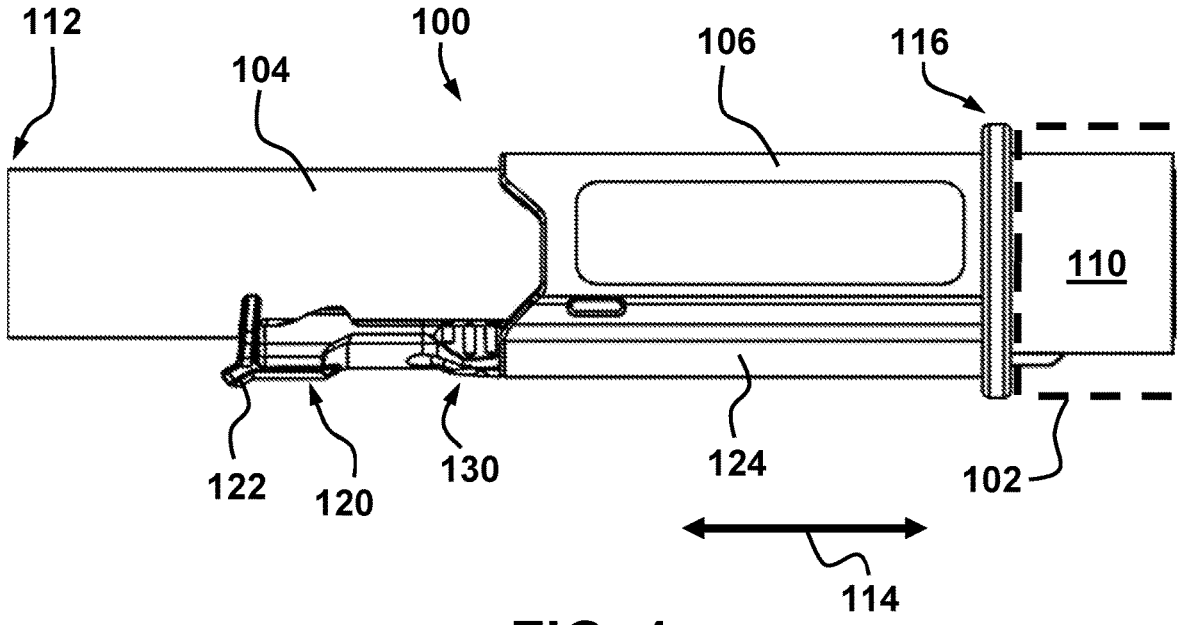
FIG. 1 is a side view illustrating an example of a spout incorporating the proposed concept.

FIG. 1 is a side view illustrating an example of a spout 100 incorporating the proposed concept. The spout 100 is designed to be mounted onto a liquid-storage container. A generic container is schematically depicted in FIG. 1 at 102. This container 102 can be, for instance, a portable container or canister designed for transporting and storing liquid fuel products, such as gasoline or diesel. The spout 100 as illustrated is well adapted for use with hazardous volatile liquids such as fuel products. Nevertheless, the spout 100 can work equally well with a very wide range of liquids that are not fuel or hazardous products.

The spout 100 includes a first member 104 and a second member 106. They are both in a sliding engagement with one another. The first member 104 is preferably longer than the second member 106, as shown in the illustrated example. However, other configurations and arrangements are possible.

The first member 104 has an inner wall surface and an outer wall surface. The second member 106 also has an inner wall surface and an outer wall surface. The spout 100 extends between a base 110 and a tip 112 along a longitudinal axis 114. This longitudinal axis 114 is essentially a straight line as in the illustrated example, Variants are possible.

The first member 104 has a front end and a rear end. The second member 106 also has a front end and a rear end. The tip 112 of the spout 100 can correspond to the front end of the first member 104, as shown in the illustrated example. The base 110 is the part of the spout 100 that is inserted through the neck of the container 102 when pouring out liquids using the spout 100. The base 110 of the illustrated example has a circular shape and is designed to fit inside the neck of the container 102, as schematically shown in FIG. 1. The spout 100 can be inserted up to an enlarged outer rim portion 116 that engages the front edge of the neck. The outer rim portion 116 is made slightly larger in diameter than the inner diameter of the neck. The spout 100 can be secured to the neck, thus to the container 102, using for instance a corresponding collar (not shown) having internal threads matching the external threads on the neck. This collar can include a central opening through which the spout 100 can fit up to the outer rim portion 116. The outer rim portion 116 is then made just large enough to engage the front edge of the neck but without preventing the inner threads of the collar to mesh with the outer threads of the neck. The collar can then be tightened on the neck until the spout 100 is solidly secured and the junction with the neck is sealed. The parts of the spout 100 beyond the base 110 will extend outside the container 102 when the spout 100 is ready to be used for pouring. At the same time, the base 110 of this spout 100 will extend into the container 102 and can be longer than the neck to extend deeper. Other configurations and arrangements are possible.

The spout 100 includes a built-in shutoff valve generally positioned at or near the rearmost edge of the base 110. This valve is normally closed. Hence, the valve remains closed when untouched.

As can be seen in FIG. 1, the first member 104 can include a first bottom protrusion 120 projecting underneath the outer wall surface thereof. The first bottom protrusion 120 is positioned approximately halfway between the tip 112 and the front end of the second member 106 in the illustrated example. The illustrated spout 100 is a model having about 7 inches (17.8 cm) in length. Other configurations and arrangements for the first bottom protrusion 120 are possible. Other dimensions are possible as well.

The first bottom protrusion 120 can include an enlarged front portion, hereafter called the trigger 122, which has a surface at the front that is generally perpendicular to the longitudinal axis 114, as shown in the illustrated example. This trigger 122 is also slightly curved at the bottom in the illustrated example. Variants are possible. The trigger 122 is where an actuation force can be applied, for instance using a finger, to open the valve inside the spout 100. The valve will open in the illustrated example when the first member 104 axially slides towards the rear with reference to the second member 106. It is positioned about 1.75 inches (4.5 cm) from the tip 112. Other configurations, arrangements and dimensions are possible.

The second member 106 can include an elongated bottom conduit 124 that is longitudinally disposed along the undersurface thereof, as shown in the illustrated example. This bottom conduit 124, among other things, can enclose a biasing element to urge the valve into its normally closed position. It can also serve as a guide for a child-resistant closure (CRC) device 130, as shown in the illustrated example. This CRC device 130 can be provided for preventing young children, particularly children up to six years old, from opening the valve inside the spout 100. The CRC device 130 acts as a fail-safe childproof security system that keeps the spout 100 locked unless a release operation is performed to unlock it. The CRC device 130 can also automatically reset itself back to the locked position once the valve is minimally open, for instance of about 10%, just enough for some liquid to flow. Further details on the CRC device 130 will be given later in the present detailed description. Variants are possible. The CRC device 130 can be omitted in some implementations. Other configurations and arrangements are possible.

Figure 2:
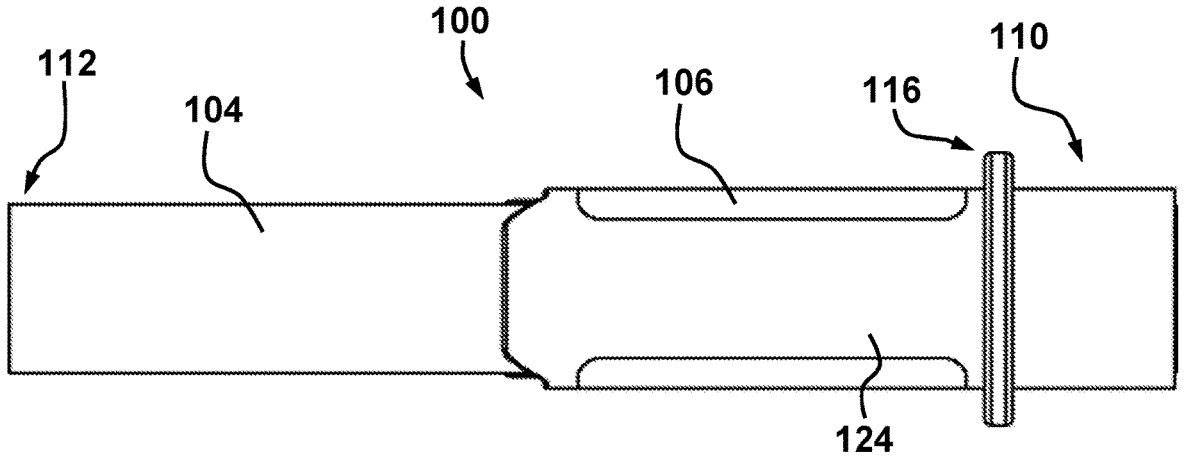
FIG. 2 is a top view of the spout in FIG. 1.
Figure 3:
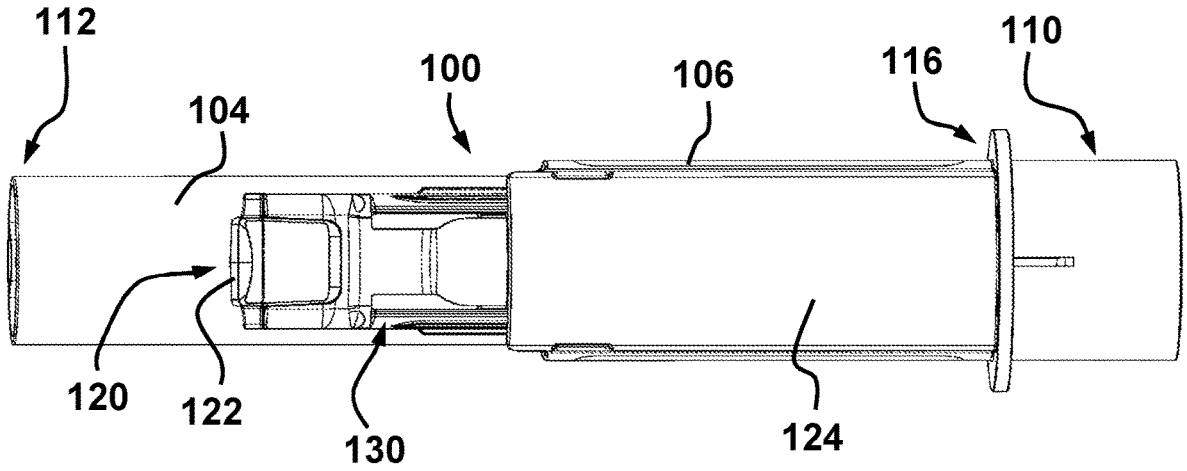
FIG. 3 is a bottom view of the spout in FIG. 1.

FIGS. 2 and 3 are, respectively, a top view and a bottom view of the spout 100 in FIG. 1. They show the various parts from different angles.

Figure 4A:
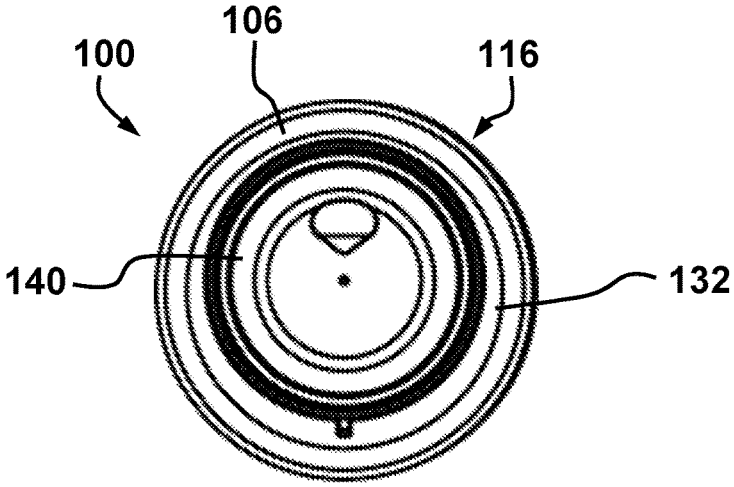
FIG. 4A is an enlarged rear view of the spout in FIG. 1.

FIG. 4A is an enlarged rear view of the spout 100 in FIG. 1. It shows that the spout 100 can have a generally circular opening 132 on the rear side of the base 110. FIG. 4A also shows the rear side of the valve 140 in the spout 100. The geometric center of the illustrated valve 140 corresponds approximately to the geometric center of the rear opening 132 in the illustrated example. As can be seen, the outer diameter of the valve 140 is essentially as wide as the outer diameter of the first member 104. Other configurations and arrangements are possible.

The first member 104 can include an elongated and generally tubular first main body 134 (FIG. 16) that extends over almost the entire length of the spout 100. Variants are possible. For instance, other shapes and configurations of the first main body 134 are possible in some implementations. It should also be noted that the word "tubular" is used in a generic way and does not imply in itself that the first main body 134 must necessarily have a circular shape on the outside in every possible implementation. Accordingly, non-circular shapes are possible. This remark also applies to other tubular parts of the spout 100.

Figure 4B:
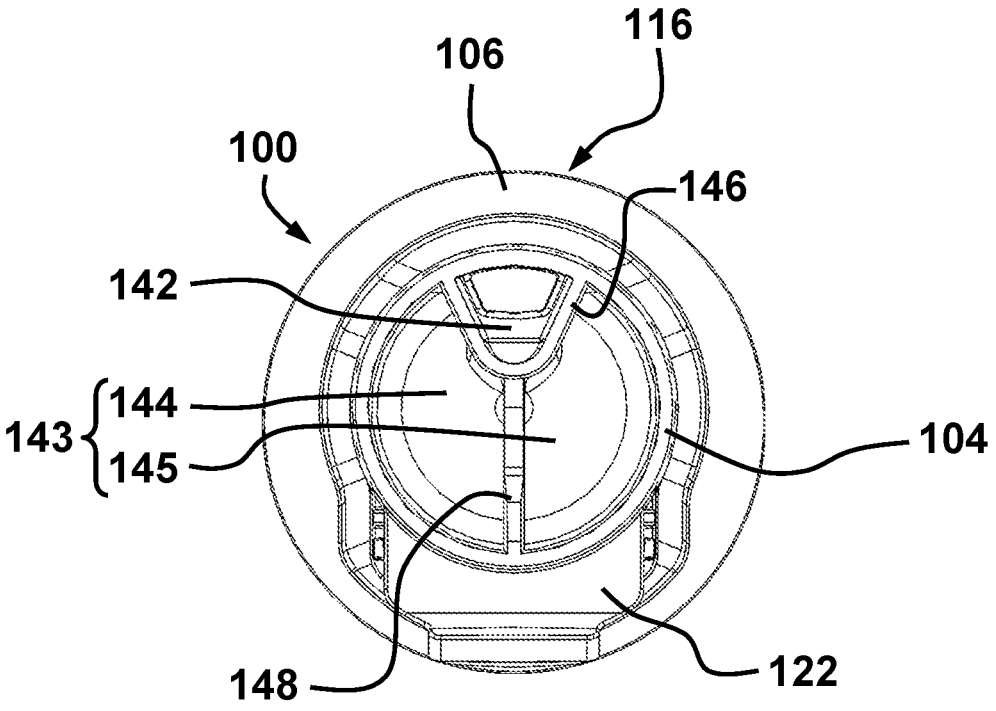
FIG. 4B is an enlarged front view of the spout in FIG. 1.

FIG. 4B is an enlarged front view of the spout 100 in FIG. 1. FIG. 4B illustrates the configuration of various walls as seen through the tip 112 of the example in FIG. 1. Other configurations and arrangements are possible.

The first member 104 includes at least two distinct internal passageways that are entirely enclosed therein, namely by the outer sidewall of the first member 104. One of the internal passageways is an air duct 142 and the other is a liquid duct 143. As can be seen in FIG. 4B, the liquid duct 143 is subdivided in two separate liquid duct portions 144, 145 in the illustrated example. These liquid duct portions 144, 145 are running parallel to one another and are substantially symmetrical. Variants are possible.

The air duct 142 is segregated from the liquid duct 143, in order words is physically separated from it, along substantially the entire length of the first member 104 up to near the valve 140 by a wall 146. This wall 146 is substantially V-shaped in the illustrated example. The air duct 142 is generally positioned along a top side of the first member 104 and is much smaller in cross section than that of the liquid duct 143. Other configurations and arrangements are possible. For instance, it is possible to have an undivided liquid duct in some implementations. Having more than two liquid duct portions is also possible. Other variants are possible as well.

The two liquid duct portions 144, 145 are separated from one another by an intervening wall 148 extending longitudinally inside the first member 104, as shown in the illustrated example. The intervening wall 148 can be substantially rectilinear, can have smooth surfaces on both sides, and can extend vertically at the center of the first member 104 up to the underside of the V-shaped wall 146, as shown in the illustrated example. Other configurations and arrangements are possible as well. The intervening wall 148 in the illustrated example is holeless, thus without perforations, voids or the like along the intervening wall 148 to keep the liquid flow as laminar as possible when liquid is poured over its entire length. Nevertheless, it could be possible to have perforations, voids or the like along the intervening wall 148 in some implementations. Some implementations could also have liquid duct portions that are not symmetrical, liquid duct portions dissimilar in size, or both. The intervening wall 148 be partial or discontinued, i.e., not extending along the full length of the liquid duct portions 144, 145. The intervening wall 148 can also be omitted entirely in some implementations. Other variants are possible as well.

Figure 5:
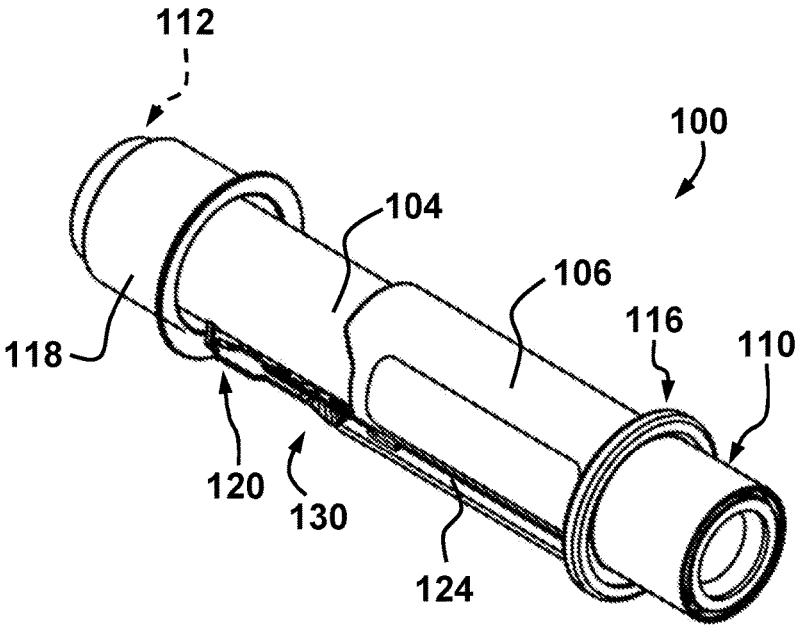
FIG. 5 is a rear isometric view of the spout in FIG. 1 when a protective cap is inserted over its tip.
Figure 6:
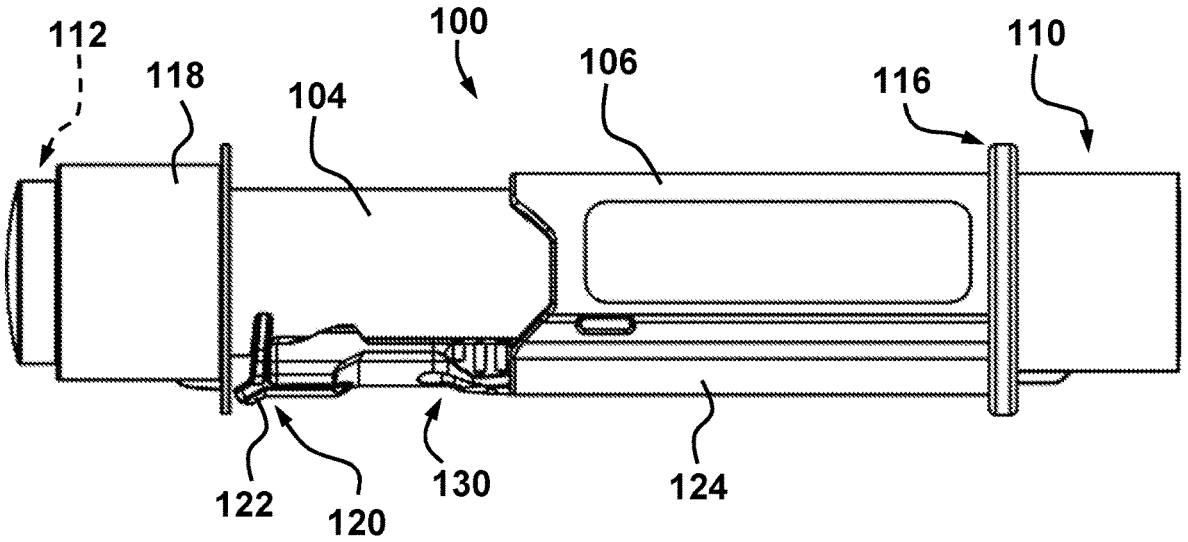
FIG. 6 is a side view of the spout with the cap in FIG. 5.

The spout 100 of FIG. 1 includes a complementary protective cap 118. This removable cap 118 can be set over the tip 112 of the spout 100, as shown in FIG. 5. FIG. 5 is a rear isometric view of the spout 100 in FIG. 1 when the protective cap 118 is inserted on the front end of the first member 104. FIG. 6 is a side view of the spout 100 with the cap 118 in FIG. 5. This cap 118 can be press-fitted on the front end of the first member 104 and be kept in that position because of an interfering engagement between the parts. This cap 118 may be useful for preventing undesirable matters, such as water, dirt, etc., from entering inside the spout 100 through the tip 112 during storage and transportation, for instance when the spout 100 extends outside of the container 102. Other configurations and arrangements are possible. The cap 118 can be omitted in some implementations.

Figure 7:
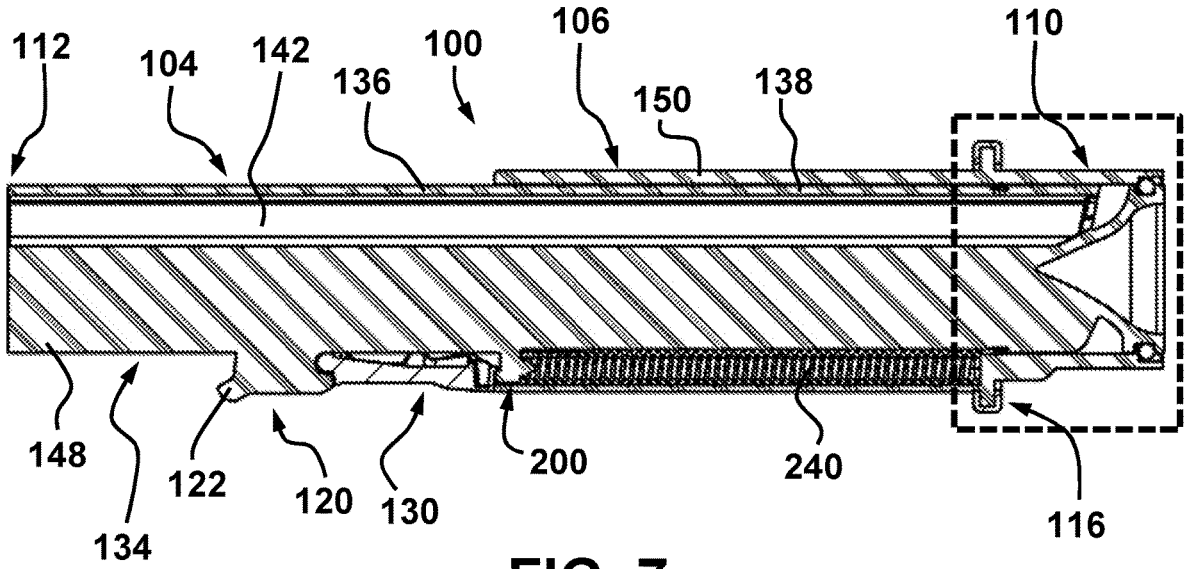
FIG. 7 is a longitudinal cross section view of the spout in FIG. 1.

FIG. 7 is a longitudinal cross section view of the spout 100 in FIG. 1 to show the parts therein. The valve 140 is in its normally closed position in FIG. 7 and the spout 100 is thus closed.

As shown in FIG. 7, the illustrated first main body 134 has a front section 136 and a rear section 138. The front section 136, in the normally closed position, is generally positioned outside the second member 106 while the rear section 138 is generally positioned inside the second member 106, as shown. Other configurations and arrangements are possible.

The second member 106 includes an elongated main body 150. This main body 150 has a straight tubular inner conduit 152 (FIG. 33) inside which the rear section 138 of the first main body 134 is inserted in the illustrated example. They can be both in sliding engagement with one another along the longitudinal axis 114. Other configurations and arrangements are possible.

The passageway provided by the air duct 142 can be seen in FIG. 7, but those of the liquid duct portions 144, 145 are not visible because the structure at the center of the first member 104 below the air duct 142 is the intervening wall 148 in the illustrated example. The two liquid duct portions 144, 145 are located on each side of the intervening wall 148.

Figure 8:
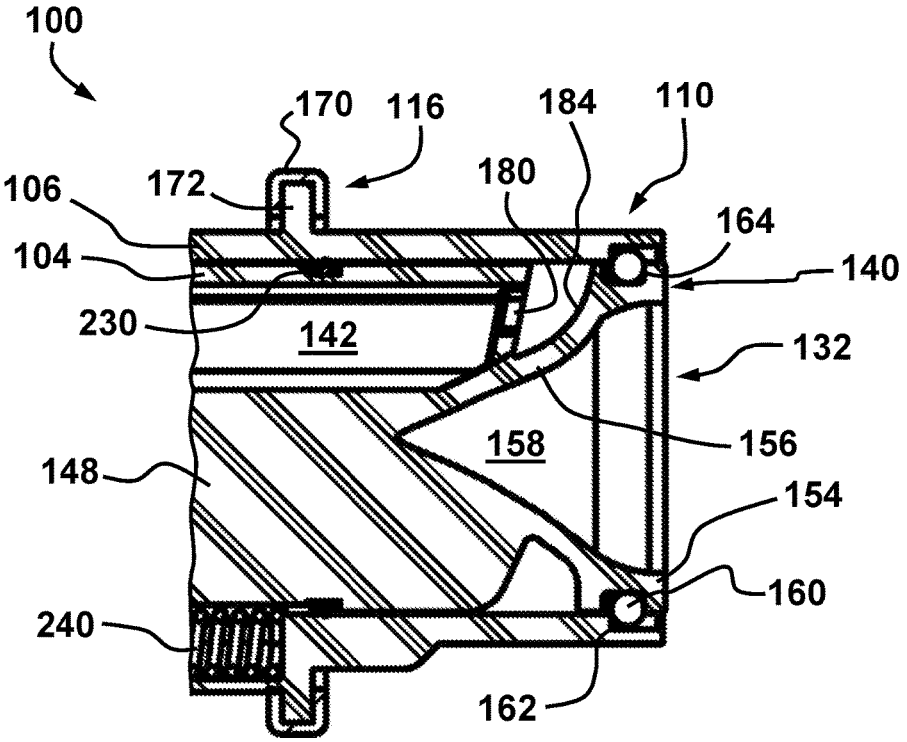
FIG. 8 is an enlarged view of the base of the spout in FIG. 7.

FIG. 8 is an enlarged view of the base 110 of the spout 100 in FIG. 7. The corresponding enlarged area is identified in FIG. 7 using the stippled line. FIG. 8 shows various details concerning the valve 140 of the illustrated example. The valve 140 simultaneously controls both the flow of liquid coming out of the container 102 and the flow of air coming therein. This air is required for the liquid to flow out of the container 102 quickly and continuously.

Portable containers, such as those commonly available for transporting and storing for fuel products, generally include an auxiliary vent opening. This auxiliary vent opening is relatively small in size and is normally closed by a corresponding threaded cap or the like. It is provided for releasing built-in pressure inside the containers or to admit air when pouring liquids using non-vented spouts. Such auxiliary vent opening should remain completely closed when pouring liquid using the vented spout 100. Nevertheless, the spout 100 can still be used even if the auxiliary vent opening is partially or fully opened but the user will then miss a desirable feature thereof. For the sake of simplicity, the rest of the present detailed description will assume that air can only enter the container 102 through the vented spout 100 during pouring.

The valve 140 has a main body that includes an enlarged rear section 154 and a front tapered section 156 extending in front of the rear section 154. The front section 156 has a somewhat conical shape that facilitates the flow of liquid towards the interior of the liquid duct portions 144, 145 when the valve 140 is open. The valve 140 is an integral part of the first member 104 in the illustrated example. It is provided at the rear end of the first member 104 and is immediately upstream of the entrance of the liquid duct portions 144, 145. Other configurations and arrangements are possible.

The rear side of the valve 140 includes a rear-facing open cavity 158 devoid of passageways to the opposite side thereof. This cavity 158 is only present to minimize the amount of plastic resin material during manufacturing. Nevertheless, the rear side of the valve 140 can be configured differently and the cavity 158 can even be entirely omitted, i.e., being filled, in some implementations.

When the spout 100 of the illustrated example is closed, as shown in FIGS. 7 and 8, a valve gasket 160 located around the rear section 154 of the valve 140 engages a valve seat 162 located within the rear opening 132 or very close to it. This valve gasket 160 can be positioned in a corresponding mounting groove 164 at the outer periphery of the rear section 154 of the valve 140. It is made of a resilient elastomeric material and can be an O-ring, as shown. The valve gasket 160 also prevents the first member 104 from being removed out of the second member 106. Other configurations and arrangements are possible. The valve gasket 160 could be omitted in some implementations.

FIG. 8 further shows that in the illustrated example, the outer rim portion 116 includes a removable outer gasket 170 mounted over an outer peripheral flange 172 radially projecting around the second member 106. This flange 172 is an integral part of the second member 106 in the illustrated example. The outer gasket 170 can be made of a resilient elastomeric material. It is useful, among other things, for sealing the junction between the neck of the container 102 and the spout 100 when attached thereon. Other configurations and arrangements are possible.

Figure 9A:
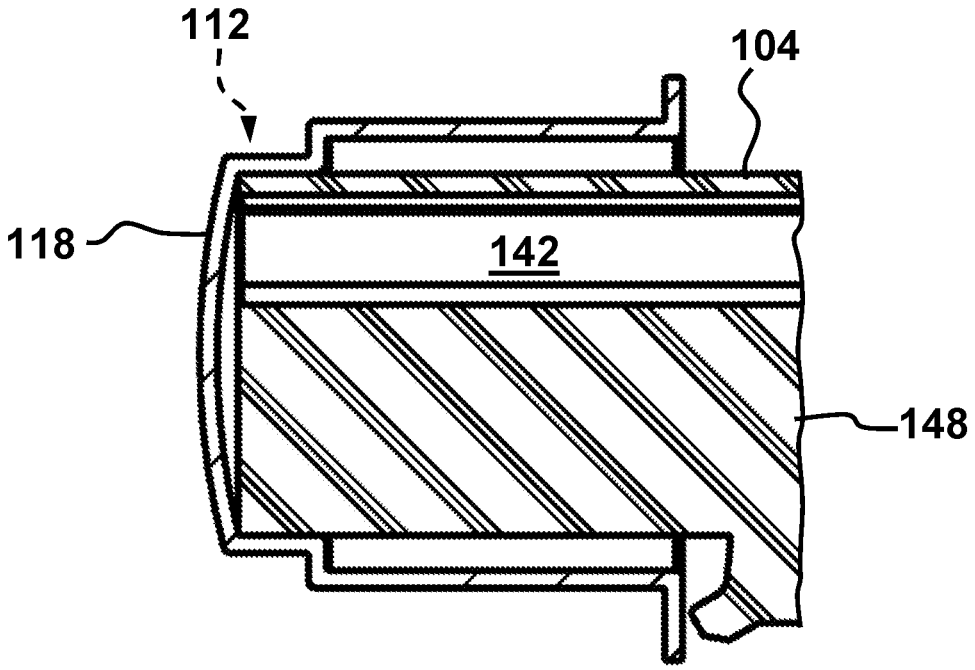
FIG. 9A is an enlarged cross section view of the spout in FIG. 7 when its cap shown in FIG. 5 is inserted over the tip.

FIG. 9A is an enlarged cross section view of the spout 100 in FIG. 7 when its cap 118 shown in FIG. 5 is inserted over the tip 112. As can be seen, the cap 118 in the illustrated example includes two juxtaposed tubular segments having different diameters. The tip 112 fits into the smaller segment, namely the one near the front end of the cap 118, with an interfering engagement. Other configurations and arrangements are possible as well.

Furthermore, if desired, the spout 100 of the illustrated example can be positioned almost entirely inside the container 102 when no liquid must be poured, for instance during storage or transportation of the container 102. To do so, the spout 100 can be inserted through the neck of the container 102, with the tip 112 first, until the outer rim portion 116 abuts on the front edge of the neck. The collar can then be tightened on the neck of the container 102 to secure the spout 100 and seal the container 102. Putting the spout 100 inside the container 102 could be desirable for minimizing space, among other things, since only the base 110 will then extend outside the container 102.

Figure 9B:
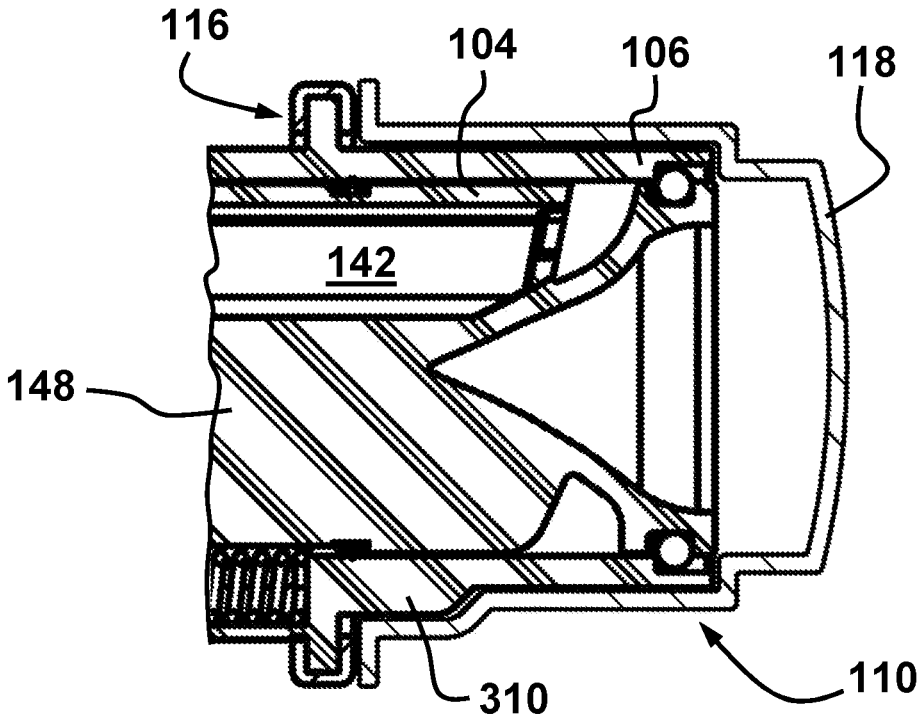
FIG. 9B is the enlarged cross section view of the spout in FIG. 8 when its cap shown in FIG. 5 is inserted over the base.

The cap 118 of the illustrated example is designed to be inserted over the base 110 to protect it, as shown for instance in FIG. 9B. FIG. 9B is the enlarged cross section view of the spout 100 in FIG. 8 when its cap 118 is inserted over the base 110. The cap 118 can be put in place either before or after the collar is threaded on the neck. Inserting the cap 118 before the collar can prevent the cap 118 from being inadvertently or accidentally removed. The base 110 is engaged by the larger segment of the cap 118 with an interfering engagement. Other configurations and arrangements are possible. As aforesaid, the cap 118 can be omitted in some implementations.

Figure 10:
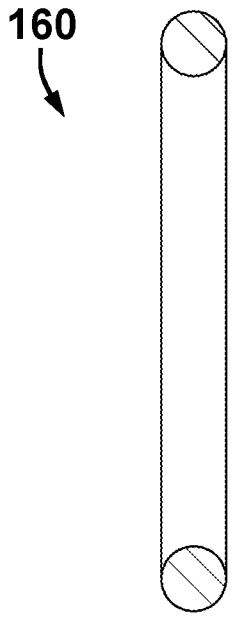
FIG. 10 is a longitudinal cross section view of the valve gasket shown in FIG. 8.

FIG. 10 is a longitudinal cross section view of the valve gasket 160 shown in FIG. 8. Other configurations and arrangements are possible as well.

Figure 11:
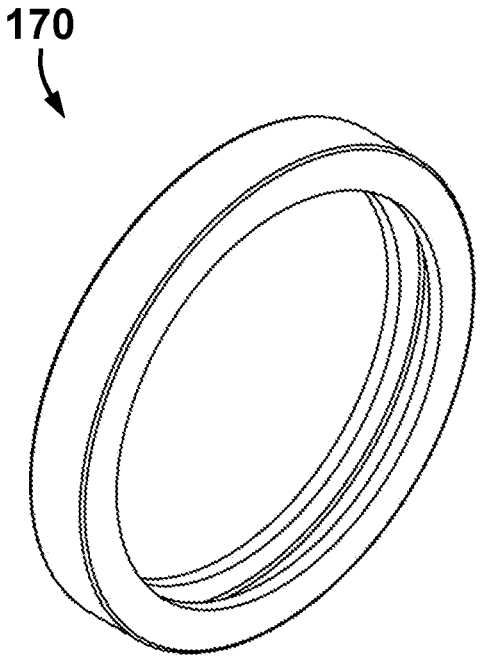
FIG. 11 is an isometric view of the outer gasket shown in FIG. 8.
Figure 12:
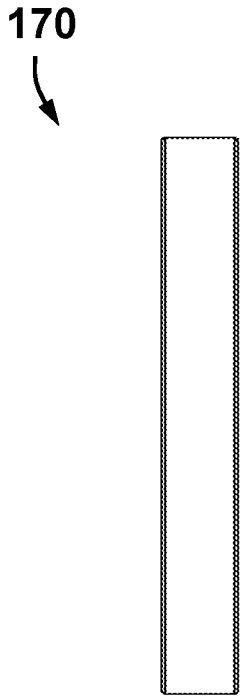
FIG. 12 is a lateral view of the outer gasket in FIG. 11.
Figure 13:
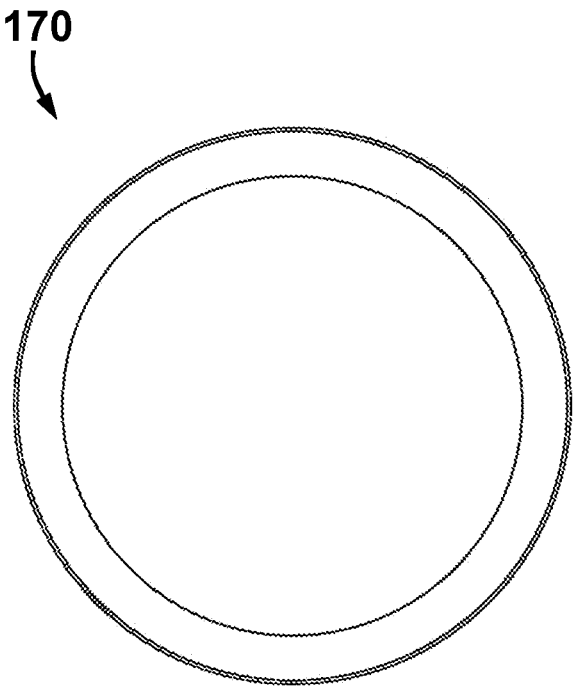
FIG. 13 is a front-side view of the outer gasket in FIG. 11.
Figure 14:
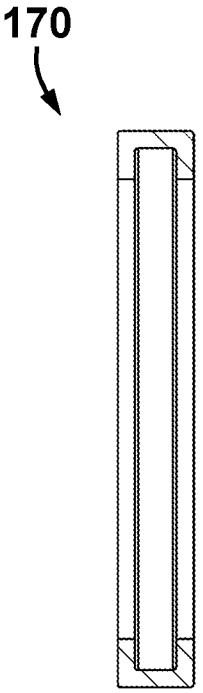
FIG. 14 is a longitudinal cross section view of the outer gasket in FIG. 11.

FIGS. 11 to 13 are, respectively, an isometric view, a lateral view and a front side view of the outer gasket 170 shown in FIG. 8. FIG. 14 is a longitudinal cross section view of this outer gasket 170. As can be seen, the body of this outer gasket 170 has a substantially U-shaped cross-section, with the open side facing radially inwards. Other configurations and arrangements are possible. For instance, the shape of the corresponding parts can be different from what is shown and described. The outer gasket 170 can also be replaced by another element, such as a coextruded part, or by something else. Still, it can be omitted entirely in some implementations, for instance when the sealing function is provided by one or more elements of the container 102 itself, or by one or more external parts. Other variants or situations are possible as well.

FIGS. 7 and 8 further show that the air duct 142 is substantially straight and uniform in dimensions from the tip 112 of the spout 100 up to at least one constricted opening 180. The internal air circuit extending from the tip 112 to the valve 140 goes through this constricted opening 180 in the illustrated example. The constricted opening 180 has a significantly smaller cross section area than that of the air duct 142 where the constricted opening 180 is the narrowest. The minimum cross section within the constricted opening 180 is preferably about 65% smaller than that of the air duct 142 upstream the constricted opening 180. Nevertheless, other proportions are possible as well. For instance, depending on the implementation, it can be from 40% to 70% smaller, namely from 40% to 45% smaller, or from 45% to 50% smaller, or from 50% to 55% smaller, or from 60% to 65% smaller, or from 65% to 70% smaller. Other values could be used as well in some specific implementations. In all instances, the constricted opening 180 is configured, sized and shaped to accelerate the air velocity at the end of the air duct 142. Air flows through the constricted opening 180 when the liquid is poured, thus when the valve 140 is open, and some liquid flows out of the container 102. The air path across the constricted opening 180 is substantially parallel to the longitudinal axis 114 (FIG. 1) in the illustrated example. It is thus in alignment with the opening at the inlet of the air duct 142. The restriction is reached within the constricted opening 180 after a depth of about 1/16 in. (1.6 mm) and the restriction continues for about 3/16 in (4.8 mm) in the illustrated example. Other configurations and arrangements are possible. For instance, although the illustrated example includes a single constricted opening 180 having a somewhat circular cross-section, using two or even more openings and other shapes could be possible in some implementations. Other variants are possible as well.

When a liquid must be poured from the container 102 and this container is, for instance a portable container, the container 102 can be tilted by a user up to a point where the liquid contacts the base 110 of the spout 100 while the valve 140 is still closed. The user can also open the valve 140 beforehand so that the liquid reaches the base 110 while the valve 140 is already open. The liquid will then start flowing out of the spout 100 passing through the internal liquid circuit extending from the valve 140 to the tip 112 of the spout 100. However, many users will generally prefer tilting the container 102 first and opening the valve 140 afterwards, particularly if the liquid level inside the container 102 is high. Among other things, the tip 112 of the spout 100 must often be positioned at a specific location to prevent spillage, for instance be in the immediate proximity or be inside an opening of a receptacle in which the liquid is transferred. An example of such receptacle includes a reservoir or tank located on a machine or on a vehicle. The receptacle can also be another container. Many other situations and contexts exist. Accordingly, the term "receptacle" is used herein in a broad generic sense.

When liquid is present at the base 110 of the spout 100 while the valve 140 is still closed, the user must eventually open the valve 140, either partially or fully, for the liquid to flow.

One suitable way of preparing the spout 100 for a pouring is to set the container 102 on the ground, depress the CRC device 130 to unlock it, if applicable, and slowly open the valve 140 by pressing backwards on the trigger 122 to remove any built-up pressure inside the container 102. Then, while maintaining the valve 140 at least partially opened, the user can lift the container 102 using two hands and move the tip 112 into position, for instance to have the tip 112 in registry with the opening of a tank. Once in position, the container 102 can be tilted upside down to begin the pouring. If desired, the user can then position the spout 100 so that the front side of the trigger 122 rests against the upper rim of the opening on the receptacle neck if one is present and that it can support the weight of the container 102, including its content. The container weight can keep the valve 140 open or at least lower the force required from the user to support the container 102 while keeping the valve 140 opened. The use can actuate the pouring flow and, if required, compensate for the change in the weight of the container 102 as liquid exits by changing the force exerted to support the container 102. The flow can also be stopped very quickly by the user upon lifting the container 102 for the valve 140 to close. This is a particularly interesting advantage when refilling a tank or another receptacle that can only receive a fraction of the quantity of liquid inside the container 102.

Liquid will start flowing around the valve 140, between the valve gasket 160 and the valve seat 162, when the valve 140 is moved rearwards over a sufficient distance relative to the valve seat 162. The liquid will then enter the liquid duct 143 but will not enter the air duct 142 because, among other things, air will come out of the constricted opening 180 at an increased velocity.

It should be noted that the valve seat 162 can be designed to keep the valve 140 closed below a certain minimum distance, for instance 0.1 inch (2.5 mm). This will prevent some liquid from entering the liquid duct 143, for instance if the tip 112 simply hits an object when the container 102 is tilted and the user is positioning the tip 112 prior to the liquid transfer. Other configurations and arrangements are possible.

The front section 156 of the valve 140 in the illustrated example includes a top surface 184 generally positioned at the top part, immediately in front of the outlet of the constricted opening 180. This top surface 184 can be obliquely disposed, for instance be slanted, curved or both. It differs from the other parts of the front section 156 in that it is provided specifically for guiding the air and facilitating the flow of air during pouring when the container 102 is tilted. The other parts are rather designed to funnel the liquid at the inlet of the liquid circuit when the liquid enters the liquid duct portions 144, 145 during pouring. Furthermore, it was found that having a very smooth finish on the top surface 184 can improve the airflow at the end of the air circuit during pouring and, as a result, improves the liquid flow. Smaller bubbles will form in the liquid when the top surface 184 has a smoother finish compared to a regular standard finish. When the first member 104 is made of plastic, the surface in the mold forming the top surface 184 can be specifically machined so as to have a surface finish with an extremely high (mirror-like) smoothness, such as A-1 (grade #3 diamond buff) or A-2 (grade #6 diamond buff) on the SPI (Society of the Plastic Industry) finish guide. This enhanced finish will only be provided for the top surface 184 to keep the costs down and it is not a finish routinely used in such context. Nevertheless, other configurations and arrangements are possible as well. It can also be omitted in some implementations.

In use, the position of the constricted opening 180, because it is part of the first member 104, will follow the position of the valve 140 with reference to the second member 106. Hence, when the valve 140 is fully open, the constricted opening 180 of the illustrated example will be positioned near or even beyond the edge of the rear opening 132, depending on the implementations.

Figure 15:
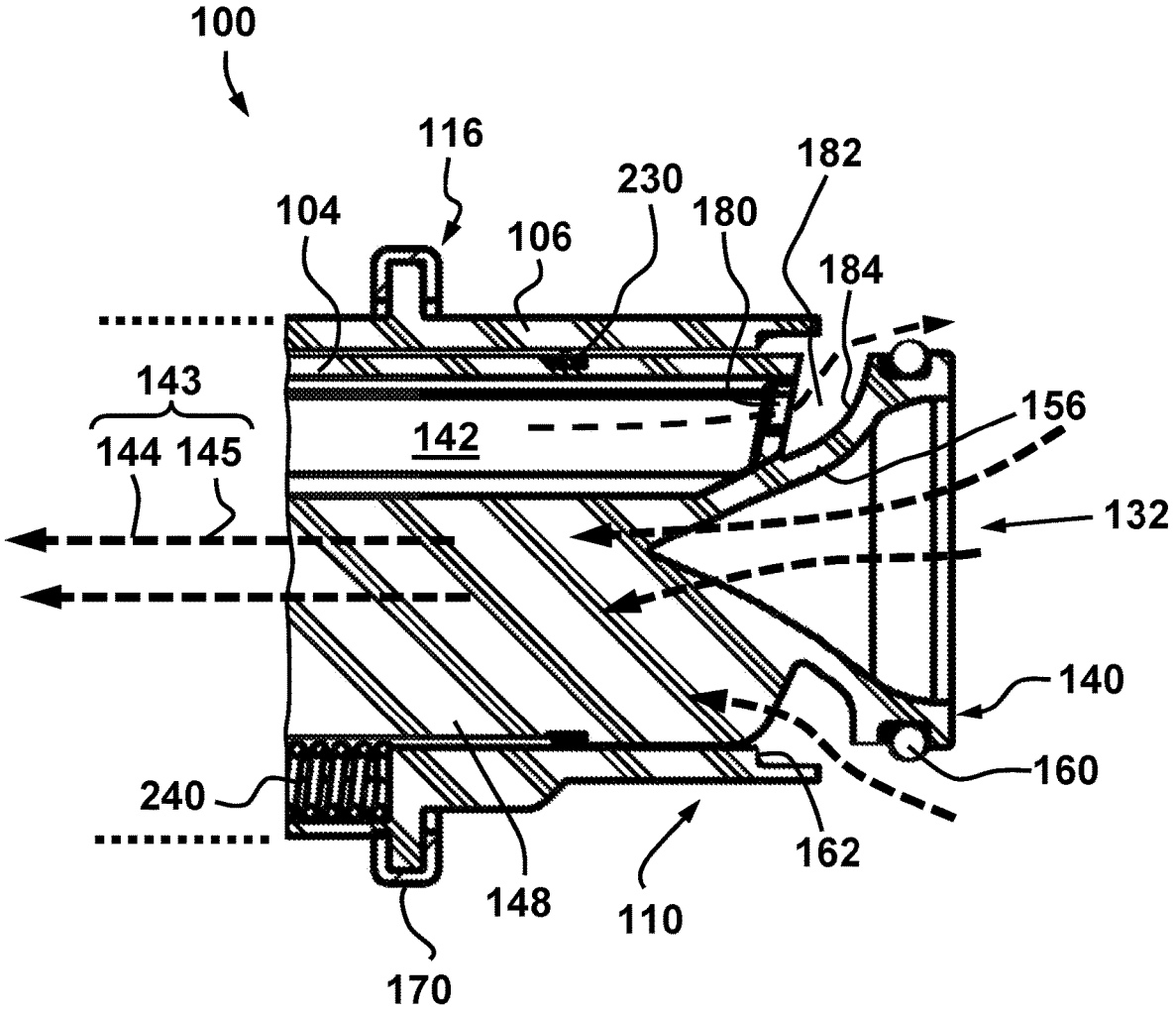
FIG. 15 is a semi-schematic view corresponding to the view of FIG. 8 when the valve is opened.

FIG. 15 is a semi-schematic view corresponding to the view of FIG. 8 when the valve 140 is open. The stippled line depicts an example of the path of the air coming out of the air duct 142 to enter the container 102 at this instant. The air circuit passes through the air duct 142 and then through the constricted opening 180 where air is accelerated. It exits the constricted opening 180 to enter in a plenum 182 defined substantially by the walls at the rear end of the air duct 142, the top surface 184 and a corresponding part of the second member 106. The air passes at the top between the inner wall of the base 110 and the valve gasket 160, and also on the sides. Keeping the liquid out of the air duct 142 results in a very fast response time when opening the valve 140 and maintains the liquid flow constant when pouring. The liquid will flow in the liquid duct portions 144, 145 as schematically shown.

It should be noted that the exact configuration and arrangement of the parts can be different in some implementations from what is shown in the figures.

FIG. 15 further shows that the spout 100 includes an inner gasket 230 configured and disposed to seal the intervening air gap between the first member 104 and the second member 106. The inner gasket 230 can also be seen in FIG. 8. It is made of a resilient material and has a generally annular shape. It is mounted inside an outer annular surface groove 232 (FIG. 17) and it includes a radially projecting outer flange around the circumference thereof in the illustrated example. The air gap closed by the inner gasket 230 is essentially the intervening space required for sliding the two members 104, 106 relative to one another. The air gap is open at the front end of the second member 106. The inner gasket 230 prevents air from passing inside the air gap, more particularly from entering the container 102 between the two members 104, 106, during a gravity transfer of the liquid when the valve 140 is open. Other configurations and arrangements are possible.

Figure 16:
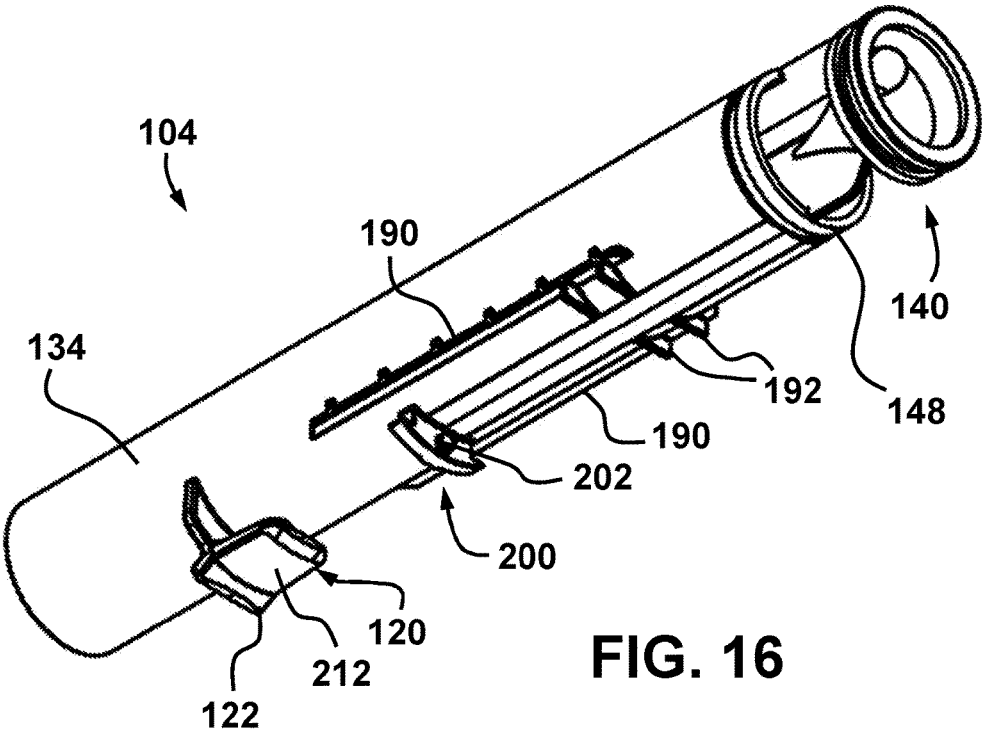
FIG. 16 is a rear isometric view of the first member shown in FIG. 1.
Figure 17:
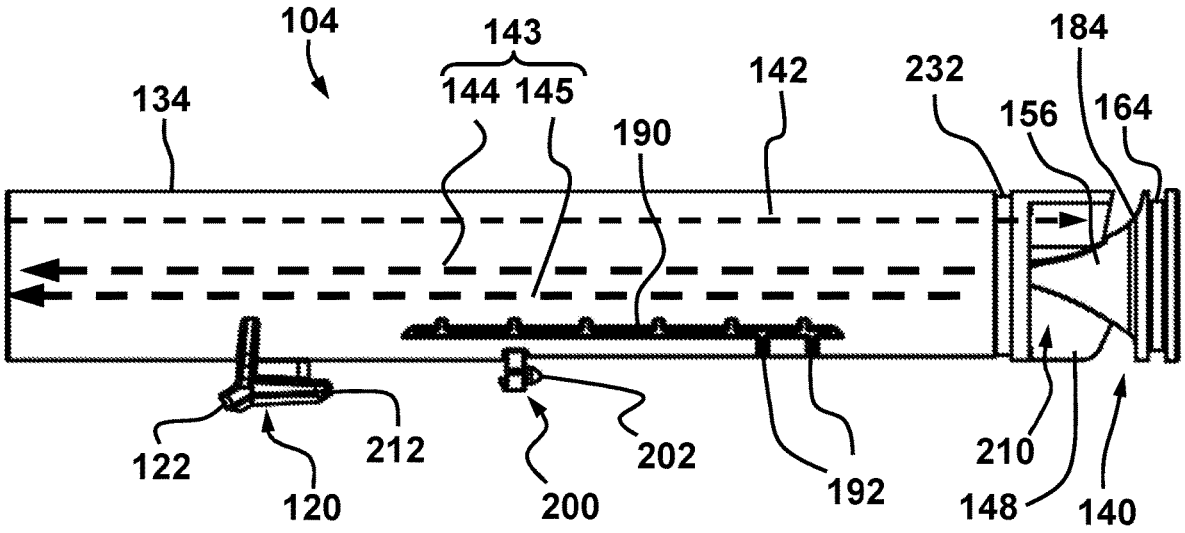
FIG. 17 is a side view of the first member in FIG. 16.
Figure 18:
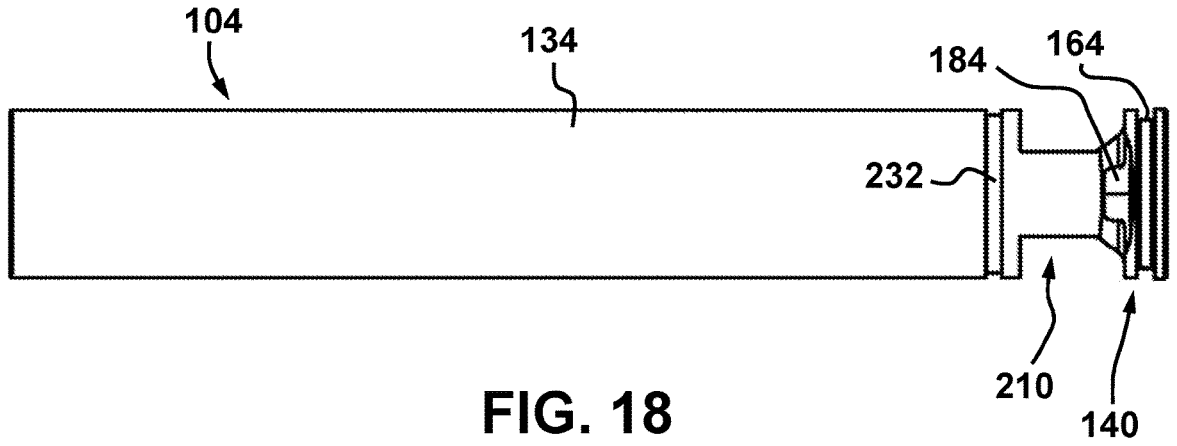
FIG. 18 is a top view of the first member in FIG. 16.
Figure 19:
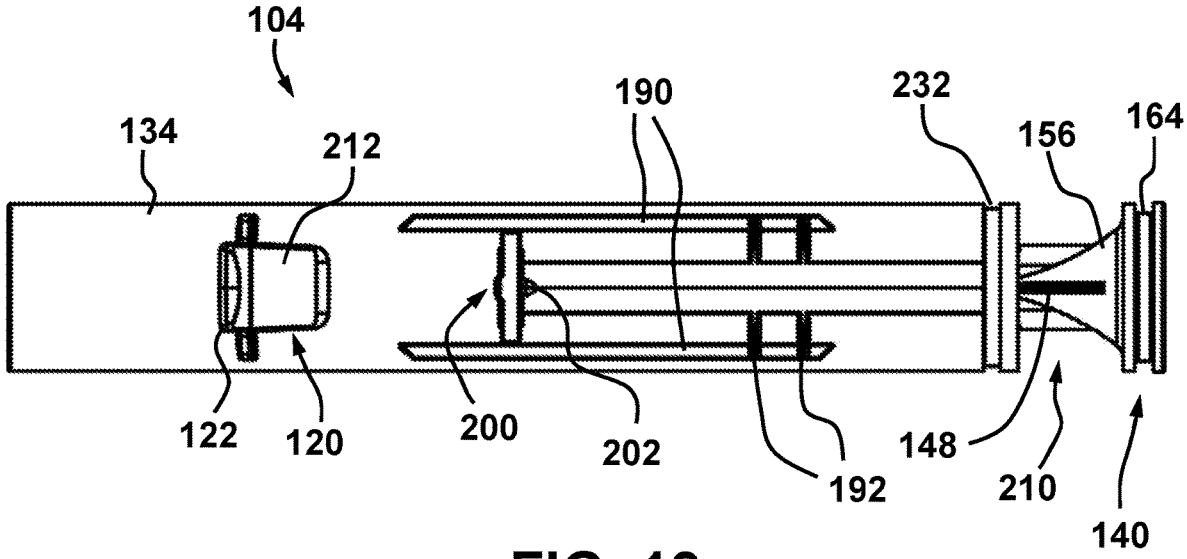
FIG. 19 is a bottom view of the first member in FIG. 16.

FIG. 16 is a rear isometric view of the first member 104 shown in FIG. 1. FIGS. 17, 18 and 19 are, respectively, a side view, a top view and a bottom view thereof. The parts of the first member 104 are all made integral with one another in the illustrated example, for instance using an injection molding process of a plastic resin material. Other materials and manufacturing processes are possible as well. Molding all parts of the first member 104 in a monolithic unitary piece, as well as other parts such as the second member 106 and the CRC device 130, can simplify manufacturing and reduce labor costs, among other things. The number of molds is also minimized. Nevertheless, in some implementations, the first member 104 could be an assembly of two or more parts. Other variants are possible.

As can be seen in FIGS. 16 to 19, the first main body 134 of the illustrated example can include a number of guiding elements projecting slightly above its outer wall surface to maintain the spacing and the alignment between the first and second members 104, 106. There are two spaced-apart and longitudinally extending lateral guiding elements 190 in the illustrated example. They will remain inside the second member 106 regardless the position of the valve 140. They both have a relatively rectilinear outer edge surface to facilitate the relative axial sliding motion between the first member 104 and the second member 106. The illustrated example further includes two pairs of spaced apart transversally disposed bottom flanges 192 extending radially outwards from the outer surface of the first main body 134. The lower edge of these flanges 192 engages the inner wall of the bottom conduit 124. Among other things, the flanges 192 prevent the first member 104 to pivot with reference to the second member 106. It should be noted that other configurations and arrangements are possible. It is also possible to omit one or more, or even all, of the guiding elements in some implementations. Other variants are possible as well.

The illustrated first member 104 further includes a second bottom protrusion 200 projecting from the outer wall surface underneath the first main body 134. The second bottom protrusion 200 is positioned approximately halfway along the tubular outer sidewall of the first main body 134 in the illustrated example. However, its position can be different in other implementations. The second bottom protrusion 200 includes a mounting member 202 projecting rearwards. This mounting member 202 provides an attachment point for the biasing element of the illustrated spout 100. Other configurations and arrangements are possible. The second bottom protrusion 200 can be omitted in some implementations.

As best shown in FIG. 17, a relatively large opening 210 surrounds the front portion of the valve 140. This opening 210 extends around the entire periphery of the front section 156 of the valve 140 in the illustrated example. The opening 210 generally corresponds to the inlet of the liquid circuit and the outlet of the air circuit. Still, FIG. 17 shows that the air duct 142 extends beyond the rear end of the liquid duct portions 144, 145 in the illustrated example. This positions the constricted opening 180 closer to the top surface 184. Other configurations and arrangements are possible.

As can be appreciated, the restrictions to the flow of liquid are also very low in the illustrated example, thereby maximizing the liquid output when the valve 140 is fully open.

FIG. 17 also shows the groove 232 for receiving the inner gasket 230 therein and that the first bottom protrusion 120 of the illustrated example includes a rear supporting element 212. The rear supporting element 212 generally extends longitudinally behind the trigger 122. It reinforces the connection of the trigger 122 with the first main body 134, but it also serves as an attachment point for the front end of the CRC device 130. Other configurations and arrangements are possible as well.

FIG. 18 is a top view of the first member 104 shown in FIG. 16. It shows, among other things, that the opening 210 is shorter in length at the top, thus near the top surface 184. Other configurations and arrangements are possible as well.

Figure 20:
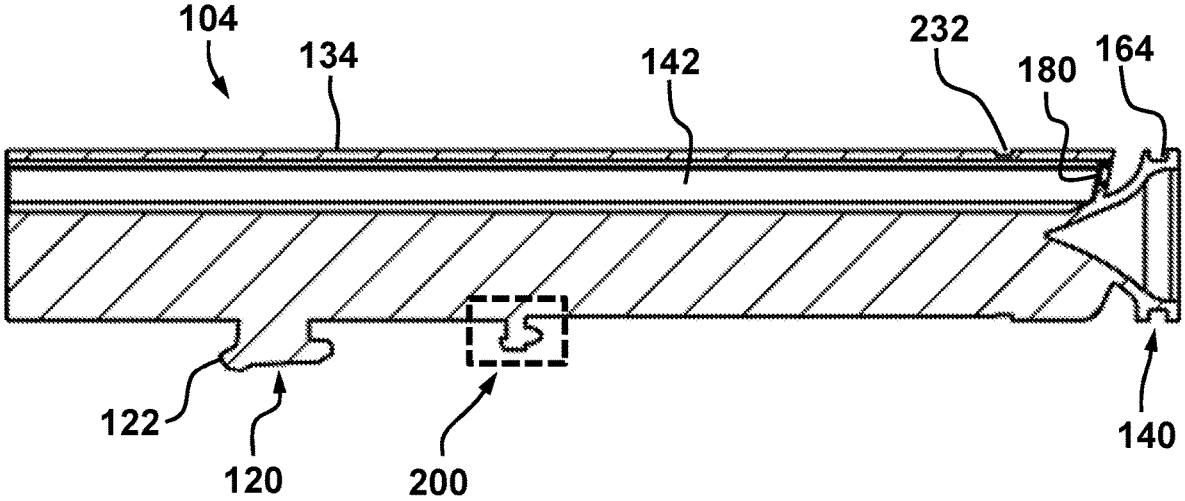
FIG. 20 is a longitudinal cross section view of the first member in FIG. 16.

FIGS. 19 and 20 are, respectively, a bottom view and a longitudinal cross section view of the first member 104 in FIG. 16.

Figure 21:
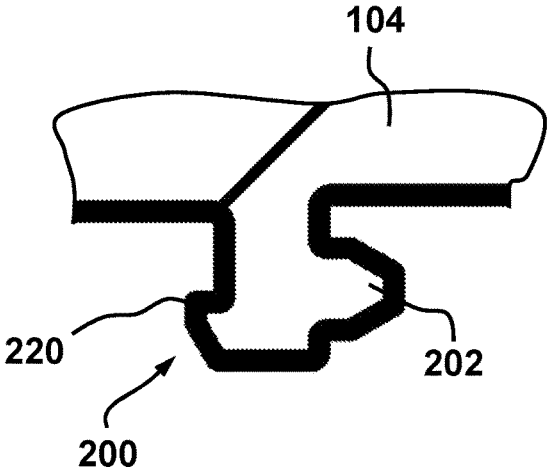
FIG. 21 is an enlarged view of the second bottom protrusion in FIG. 20.

FIG. 21 is an enlarged view of the second bottom protrusion 200 in FIG. 20. The stippled line shown in FIG. 20 outlines the corresponding enlarged area. As can be seen, the second bottom protrusion 200 in the illustrated example includes a front flange 220 defining a substantially horizontal surface. This front flange 220 is provided to cooperate with one or more features provided on the CRC device 130. Other configurations and arrangements are possible as well.

Figure 22:
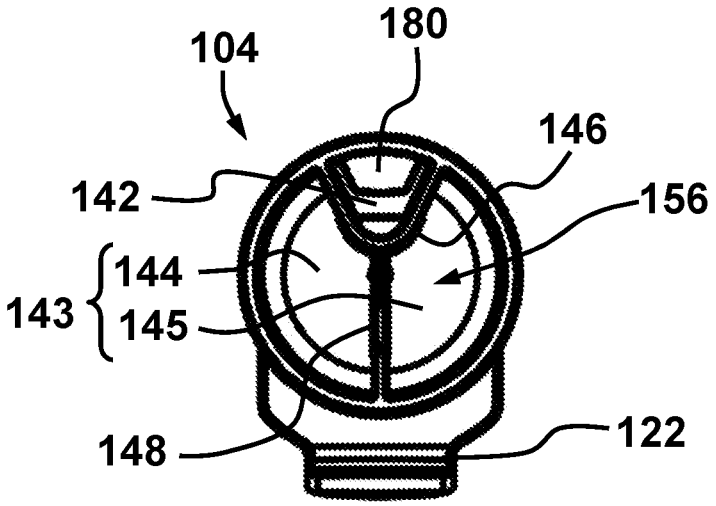
FIG. 22 is a front end view of the first member in FIG. 16.

FIG. 22 is a front end view of the first member 104 in FIG. 16. The surface of the front section 156 of the valve 140 can be seen at the far end of the liquid duct portions 144, 145. Likewise, the constricted opening 180 can be seen at the far end of the air duct 142. Other shapes, configurations and arrangements are possible.

When the first member 104 is manufactured using an injection molding process of a plastic resin material, a pin is provided within the mold to form the V-shaped wall 146 and the rear end of the air duct 142. This pin, however, is generally too small having for internal liquid channels in which a cooling liquid flows during molding. The slender pin, instead, includes an internal gas channel in which a pressurized gas, such as air, can flow through the pin and out of the mold. It is also supported and sealed at both ends to prevent the pin from moving due to the high pressures during molding. This increases dimensional accuracy and mitigates the likelihood of having defective parts. The pin can be supported at the rear, through the constricted opening 180, at the mold insert provided to create the top surface 184. The rear end of the pin enters the front side of the mold insert through a port and an air channel is provided inside the mold insert to send the pressurized air out of the mold. In use, pressurized air can enter at the front end of the pin and be vented out of the mold through the mold insert. The various connections are sealed to prevent the pressurized air from entering the parts of the molding receiving the molten plastic resin material. Cooling the pin can significantly decrease the molding cycle time, among other things. Similar pins can be provided to create the liquid duct portions 144, 145 and the intervening wall 148. Other configurations and arrangements are also possible.

Figure 23:
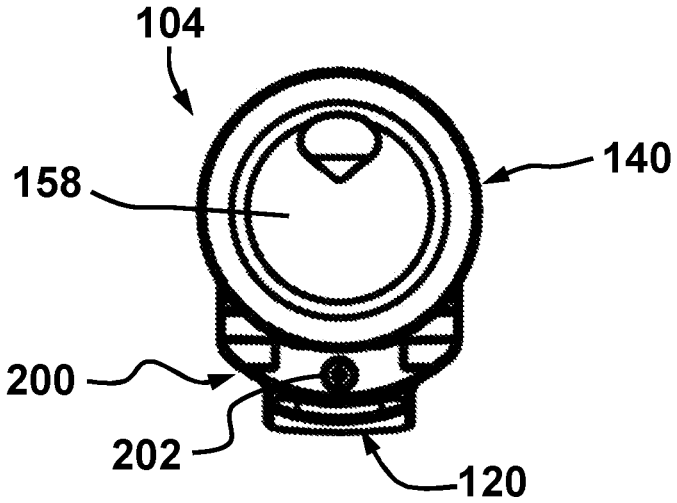
FIG. 23 is a rear-end view of the first member in FIG. 16.

FIG. 23 is a rear-end view of the first member 104 in FIG. 16. It shows, among other things, the rear-facing open cavity 158 of the valve 140, the mounting member 202 of the second bottom protrusion 200 and the rear side of the first bottom protrusion 120.

Figure 24:
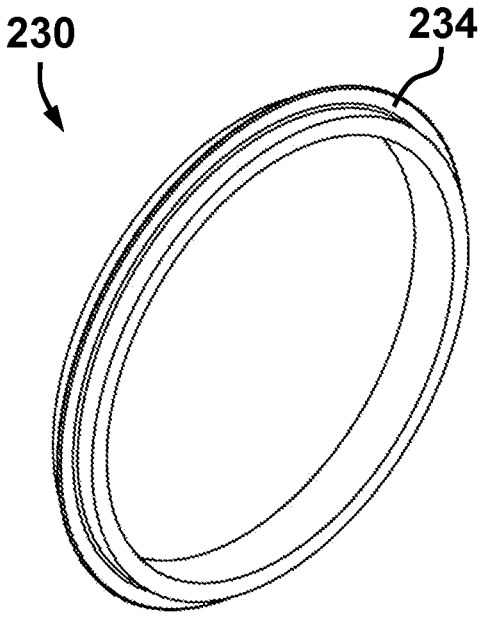
FIG. 24 is an isometric view of the inner gasket shown in FIG. 8.
Figure 25:
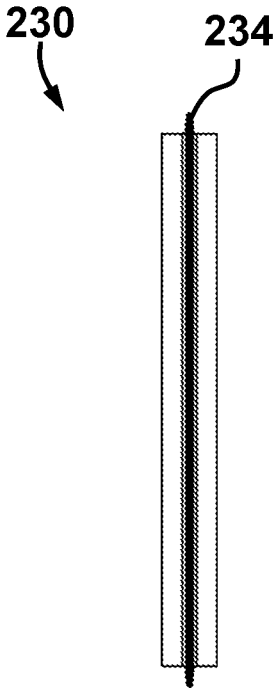
FIG. 25 is a lateral view of the inner gasket in FIG. 24.
Figure 26:
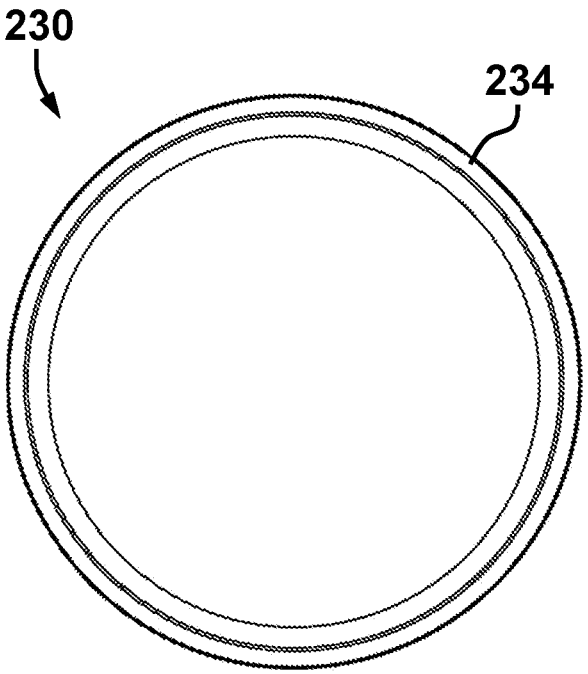
FIG. 26 is a front-side view of the inner gasket in FIG. 24.
Figure 27:
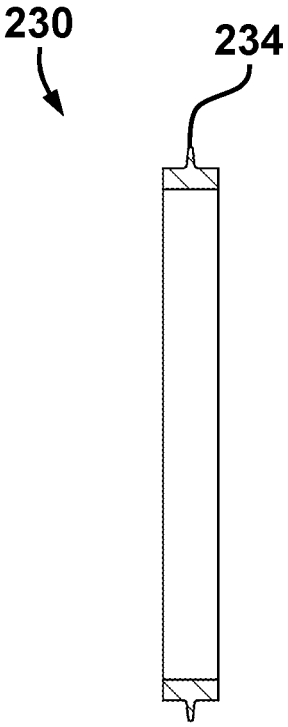
FIG. 27 is a longitudinal cross section view of the inner gasket in FIG. 24.

FIG. 24 is an isometric view of the inner gasket 230 shown in FIG. 8. FIGS. 25 to 27 are, respectively, a lateral view, a front-side view and a longitudinal cross section view of the inner gasket 230 in FIG. 24. As can be seen, the body of the inner gasket 230 has a substantially T-shaped cross-section. It includes a projecting part 234 extending radially outwards to engage the interior of the inner conduit 152. Other shapes, configurations and arrangements are possible. This inner gasket 230 can also be omitted in some implementations, for instance when it is not necessary to have a subatmospheric pressure inside the container 102 once the spout tip 112 is below the liquid level in the receptacle or when air can enter the container 102 from another opening, such as an opened auxiliary air vent. Other situations exist as well.

In use, once the container 102 is tilted, or even set upside down, to pour liquid through the spout 100, the user can open the valve 140 for the liquid to flow by gravity and maintain it opened, for instance until the receptacle is full or when a sufficient amount of liquid was transferred. The user can control and adjust the flow when pouring by actuating the position of the trigger 122 to set the position of the valve 140. The user may, for instance, progressively reduce the flow of liquid when the receptacle is almost full. This is often desirable to prevent spillage. However, it is sometimes difficult to see when the receptacle is full or almost full. Different factors can be involved, such as insufficient light, the opening of the receptacle being hidden by the container 102, by the spout 100 or by other objects, etc. These factors may force the user to pour the liquid at a slower rate or to interrupt the flow frequently to check the level, thereby increasing the time and effort required for completing the transfer and increasing the likelihood of experiencing an undesirable spillage. Still, the user may be distracted for some reason and not realize that the receptacle is now almost full, or may have overestimated the amount of liquid to be added. This also increases the likelihood of experiencing an undesirable spillage. The illustrated spout 100 can mitigate these difficulties.

As aforesaid, some air must enter the container 102 through the air duct 142 during pouring to replace the proportional volume of liquid flowing out of the liquid duct portions 144, 145. Air will stop entering the container 102 when the flow of liquid stops. However, interrupting the incoming air flow can also significantly reduce and then cut off the liquid flow shortly thereafter because of the increased negative pressure, relative to the ambient air pressure, above the liquid level inside the container 102. As aforesaid, this negative pressure built up can start when the spout tip 112 is submerged into the liquid inside the receptacle during the pouring of the liquid from the container 102. This negative pressure is what causes the air to enter but if no more air is admitted, the increased negative pressure will decrease the flow and eventually stop it.

Now, since the tip 112 of the illustrated spout 100 is where both the liquid outlet and the air inlet are located, the flow of liquid through the spout 100 will automatically decrease and then stop soon after air is prevented from entering the air duct 142. This highly desirable and convenient feature is only possible because of the airtight seal provided between the first and second members 104, 106. As aforesaid, the trigger 122 is at the front of the first bottom protrusion 120 and this is first bottom protrusion 120 is positioned approximately halfway between the tip 112 and the front end of the second member 106 in the illustrated example. Variants are possible but when the flow reduction/cut-off feature is desired, it is preferable to leave a keep a sufficient distance, for instance at least a few centimeters, between the tip 112 and the trigger 122 so that the tip 112 can be positioned well into the receptacle neck when pouring.

Furthermore, the fact that the valve 140 is located near the rear end of the base 110 allows the user to close the valve 140 after the flow stopped by itself and then move the tip 112 upwards without experiencing any spillage, even if the liquid level in the receptacle is close to the limit, since the spout 100 has no residual liquid therein once closed.

Figure 28:
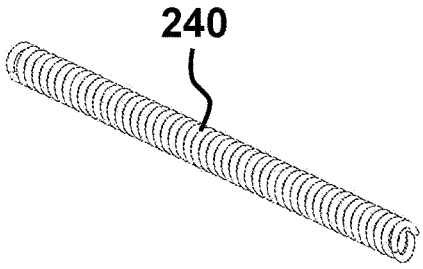
FIG. 28 is an isometric view showing an example of the spring used as the biasing element in the spout of FIG. 1.

In the illustrated example, the biasing element is a single helical compression spring 240 positioned inside the bottom conduit 124. FIG. 28 is an isometric view showing an example of the spring 240. The spring 240 can also be seen in other figures. The front end of the spring 240 engages the mounting member 202 while the rear end rests at the bottom end of the bottom conduit 124 in the illustrated example. The spring 240 is designed to generate a return force sufficient to overcome the friction between the corresponding parts and to keep the valve 140 suitably sealed in its closed position. However, it is also not too strong to impair handling by the targeted users. The spring 240 can be made of metal in some implementations. More than one spring 240 can be used in some implementations. Other materials, configurations and arrangements are also possible.

The spring 240 is completely enclosed inside the bottom conduit 124 in the illustrated example. This protects the spring 240 and prevents it from being in contact with external objects. Other configurations and arrangements are possible. Among other things, the spring 240 could be partially or even completely exposed in some implementations.

Figure 29:
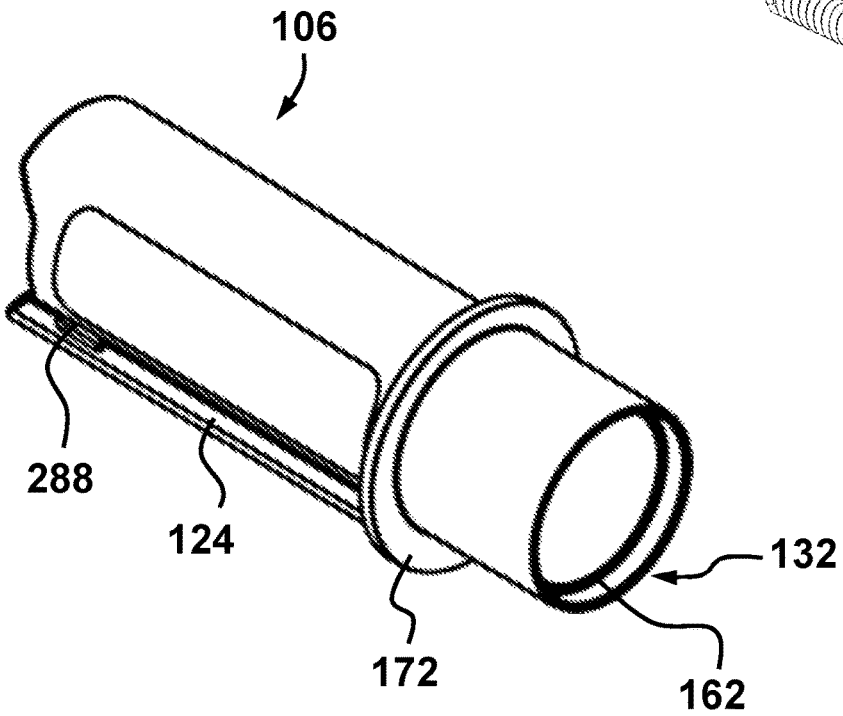
FIG. 29 is an isometric top view of the second member shown in FIG. 1.

FIG. 29 is an isometric top view of the second member 106 in FIG. 1. FIG. 29 shows, among other things, that the bottom conduit 124 located underneath the second main body 150 is open at the front end thereof.

All parts of the second member 106 can be molded together using an injection molding process and form a monolithic unitary piece. The illustrated second member 106 is an example of an implementation that can be made using an injection molding process of a plastic resin material. Variants are possible.

Figure 30:
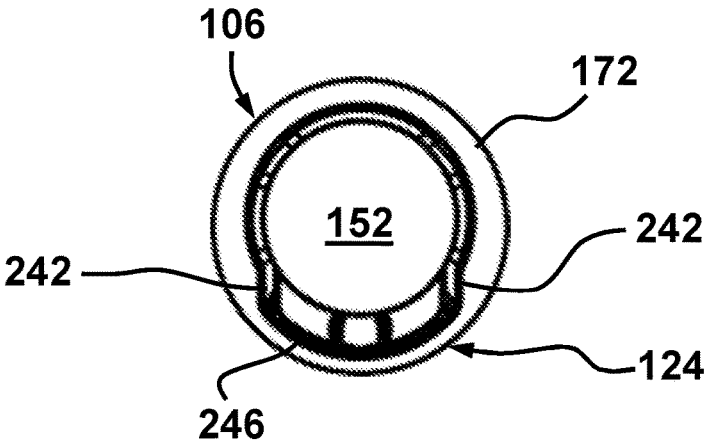
FIG. 30 is a front view of the second member in FIG. 29.

FIG. 30 is a front view of the second member 106 in FIG. 29. Among other things, FIG. 30 shows that the bottom conduit 124 in the illustrated example includes two longitudinally disposed lateral walls 242 and a longitudinally disposed bottom wall 246. The bottom wall 246 is slightly convex in the illustrated example. Variants are possible as well.

Figure 31A:
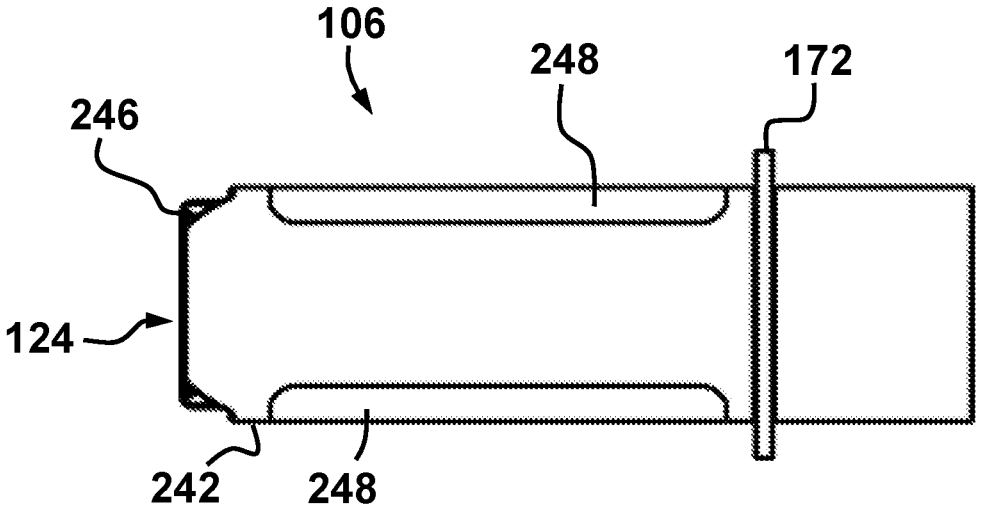
FIG. 31A is a top view of the second member in FIG. 29.
Figure 31B:
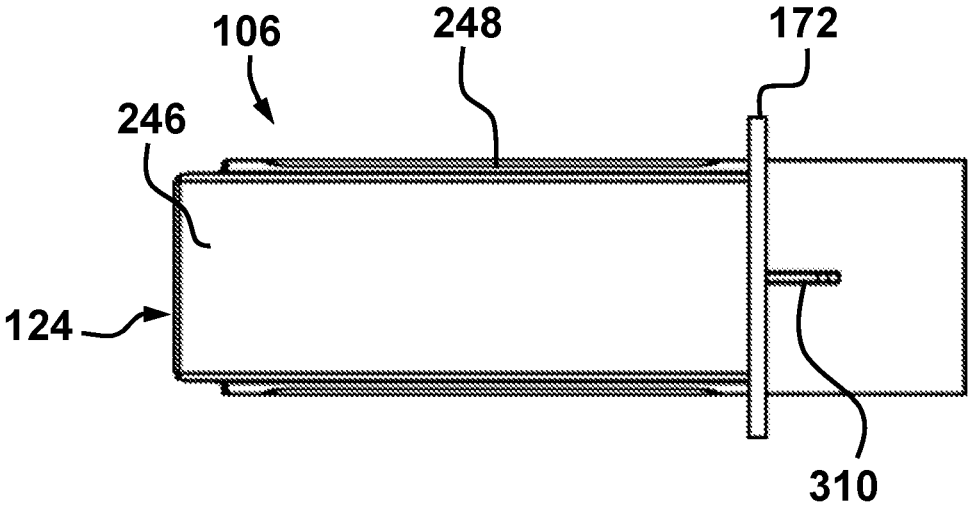
FIG. 31B is a bottom view of the second member in FIG. 29.

FIG. 31A is a top view of the second member 106 shown in FIG. 29. It shows that the lateral walls 242 in the illustrated example includes two longitudinally extending cut-out portions 248. FIG. 31B is a bottom view of the second member 106 shown in FIG. 29. Variants are possible.

Figure 32:
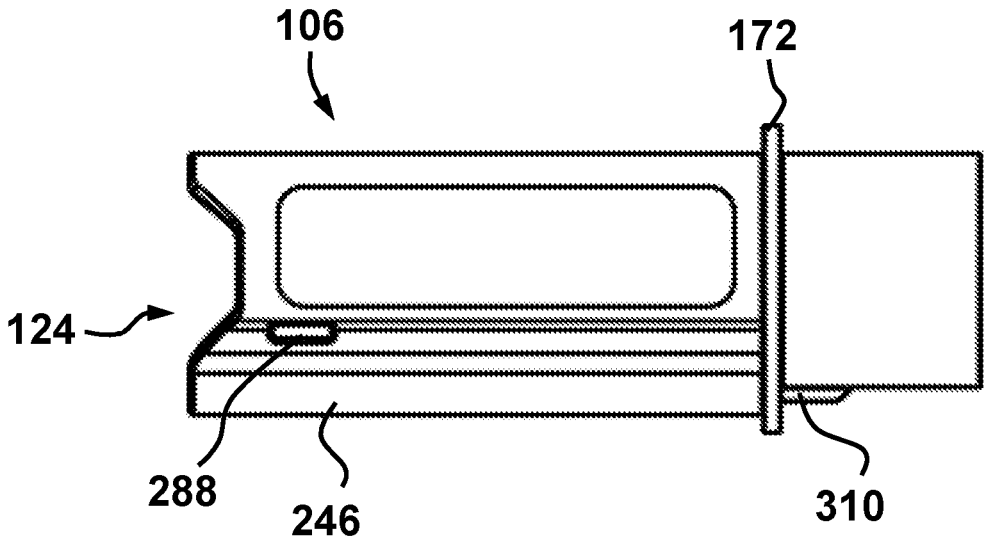
FIG. 32 is a side view of the second member in FIG. 29.
Figure 33:
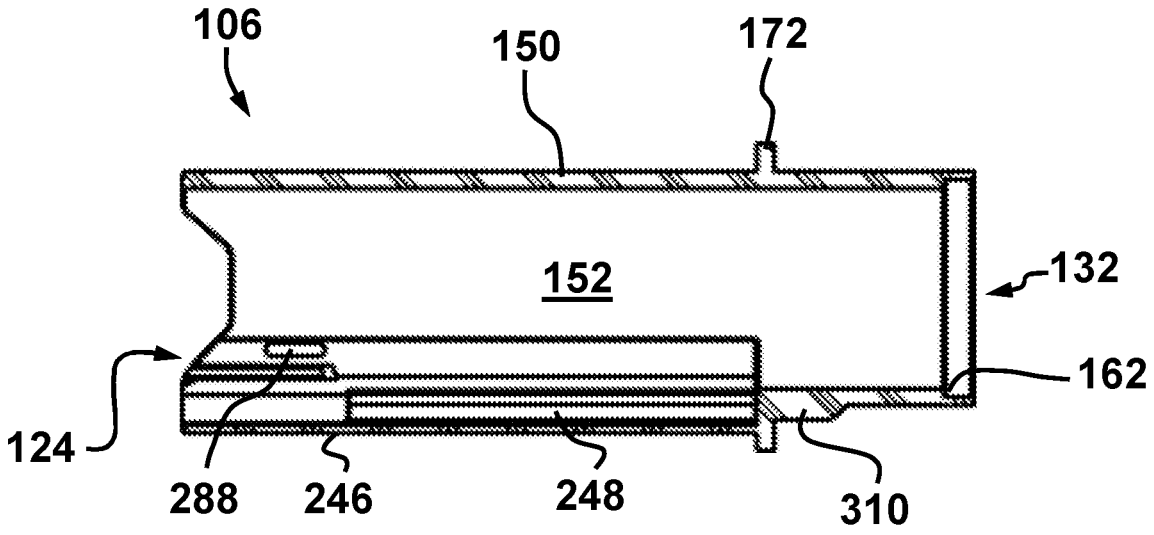
FIG. 33 is a longitudinal cross section view of the second member in FIG. 29.

FIGS. 32 and 33 are, respectively, a side view and a longitudinal cross section view of the second member 106 in FIG. 29. Other configurations and arrangements are possible. This feature can be omitted in some implementations.

Figure 34:
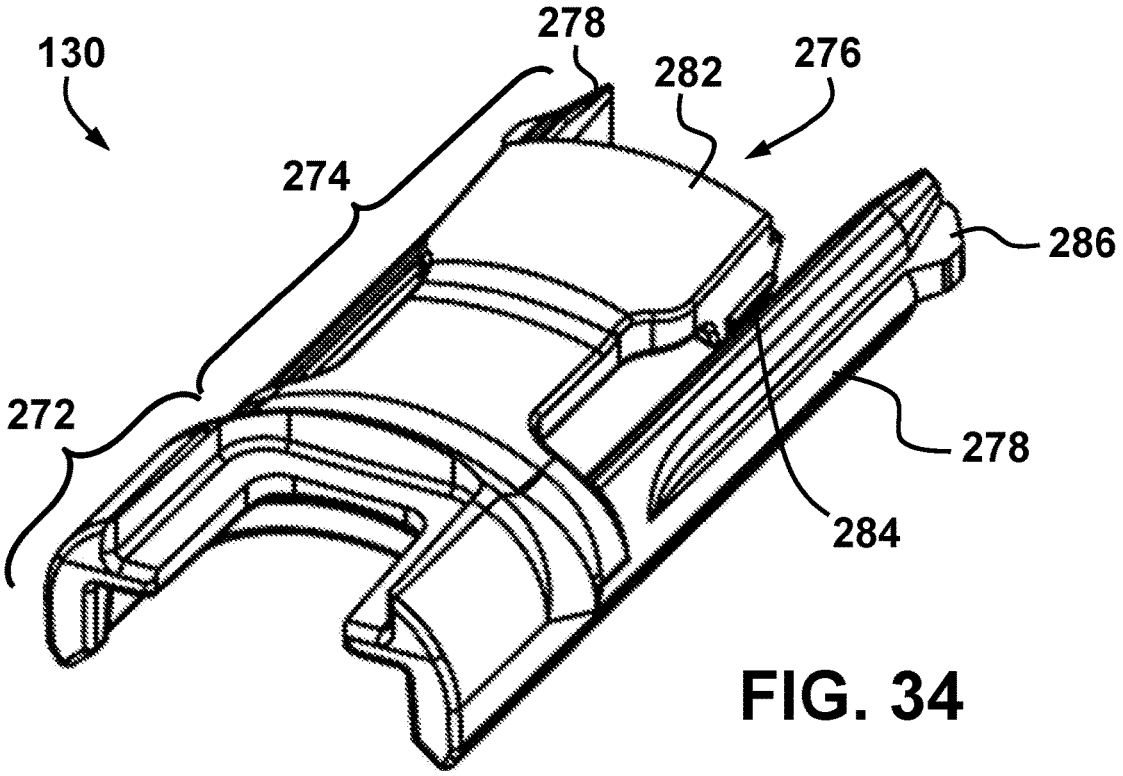
FIG. 34 is an isometric view of the CRC device shown in FIG. 1 from a first viewpoint.
Figure 35:
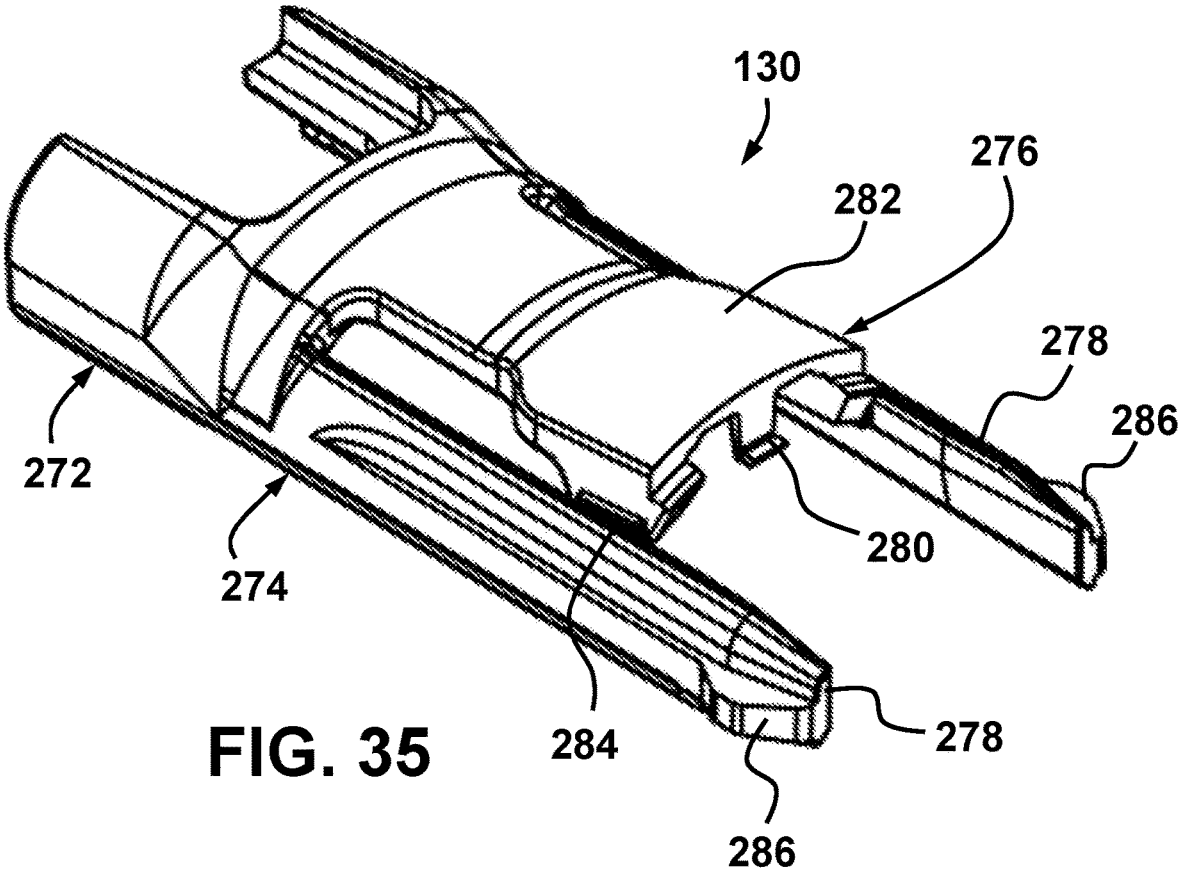
FIG. 35 is an isometric view of the CRC device in FIG. 34 from a second viewpoint.
Figure 36:
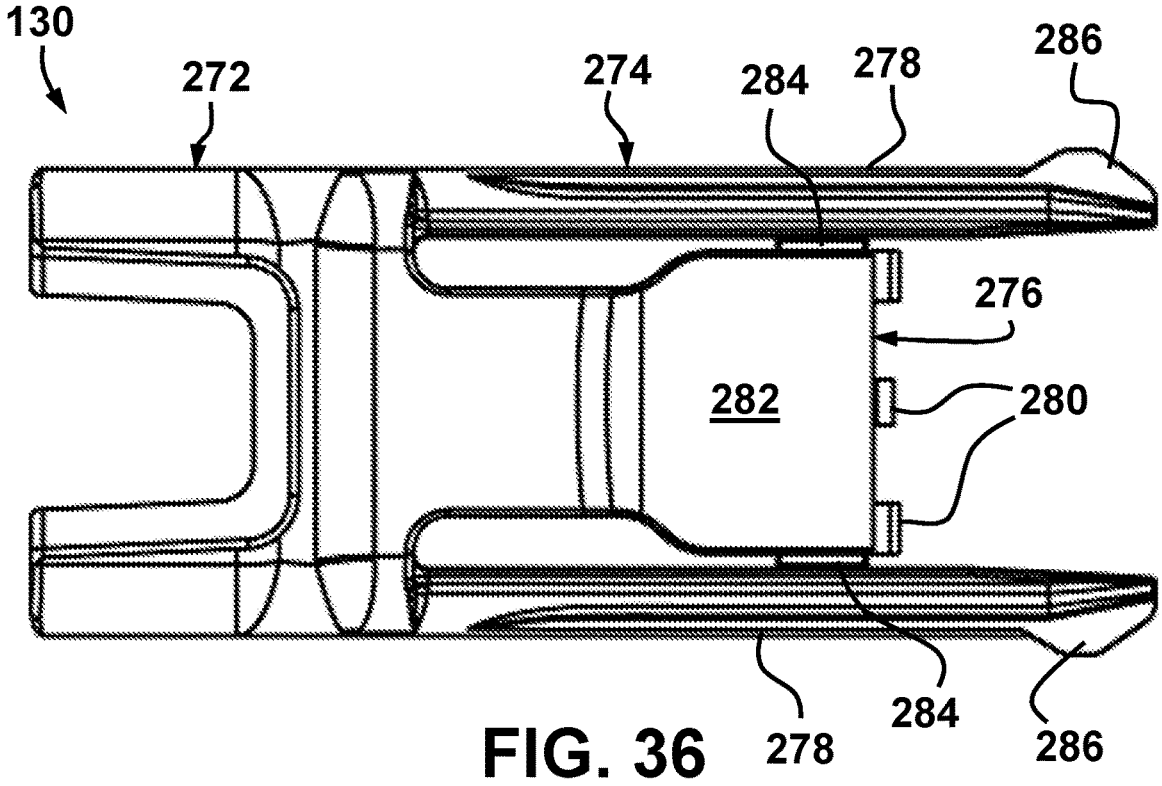
FIG. 36 is a top view of the CRC device in FIG. 34.
Figure 37:
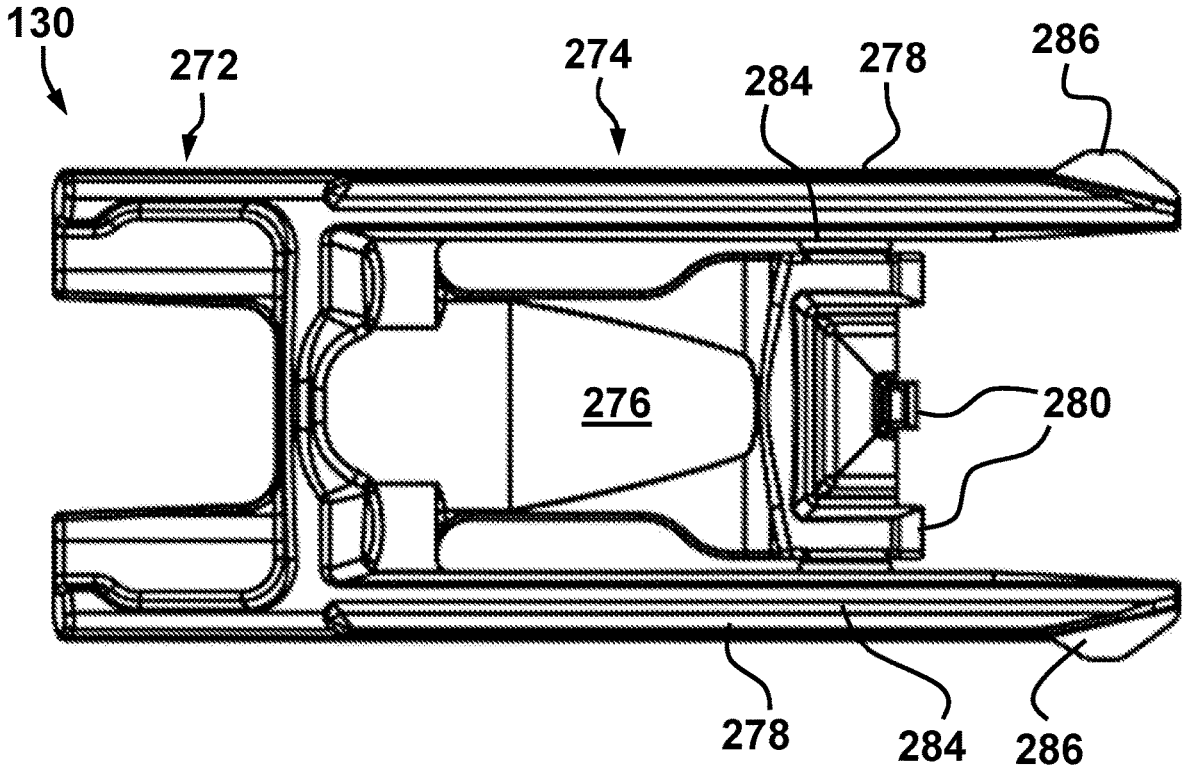
FIG. 37 is a bottom view of the CRC device in FIG. 34.
Figure 38:
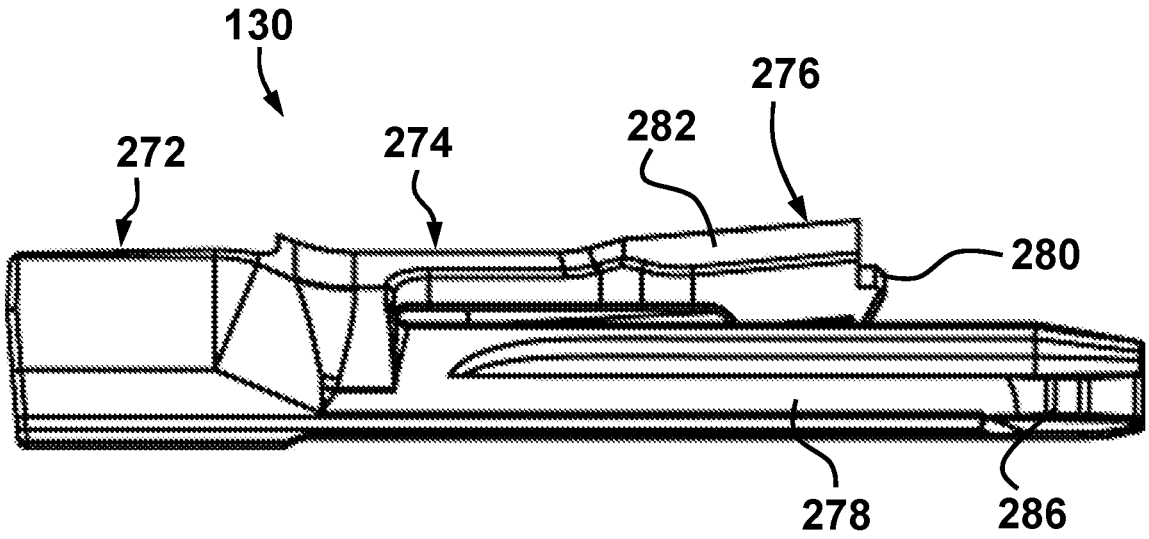
FIG. 38 is a side view of the CRC device in FIG. 34.
Figure 39:
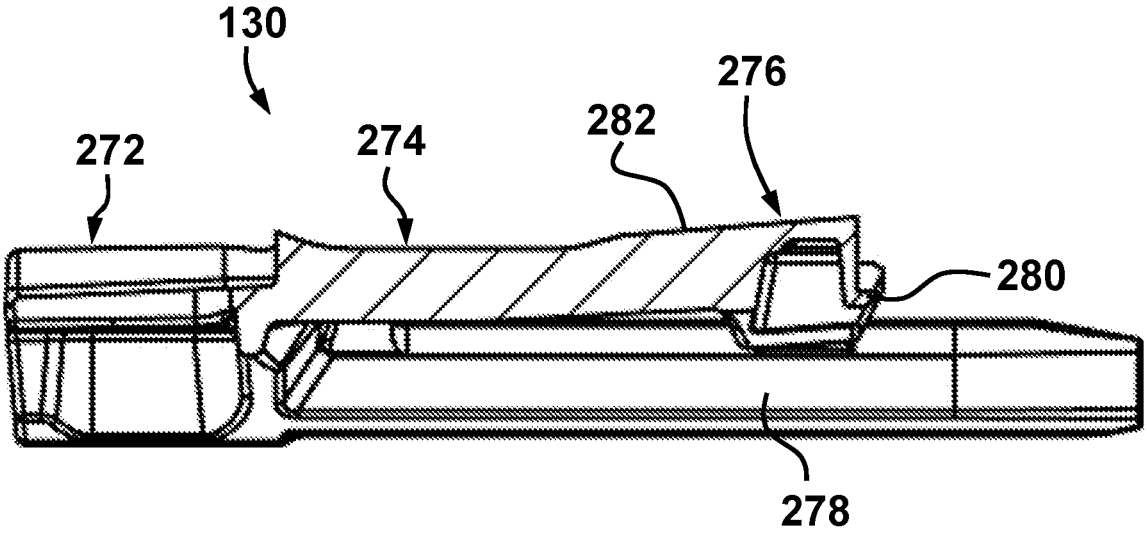
FIG. 39 is a longitudinal cross section view of the CRC in FIG. 34.
Figure 40:
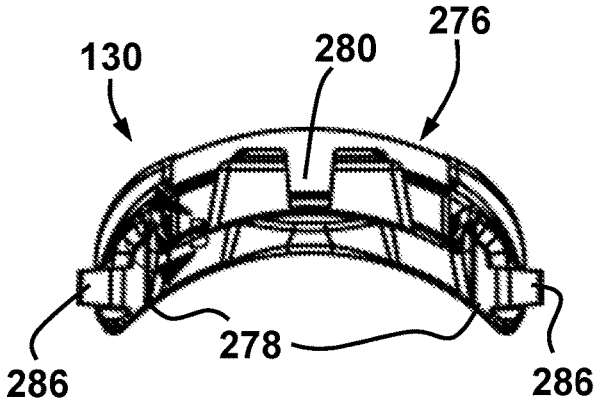
FIG. 40 is a rear-end view of the CRC device in FIG. 34.
Figure 41:
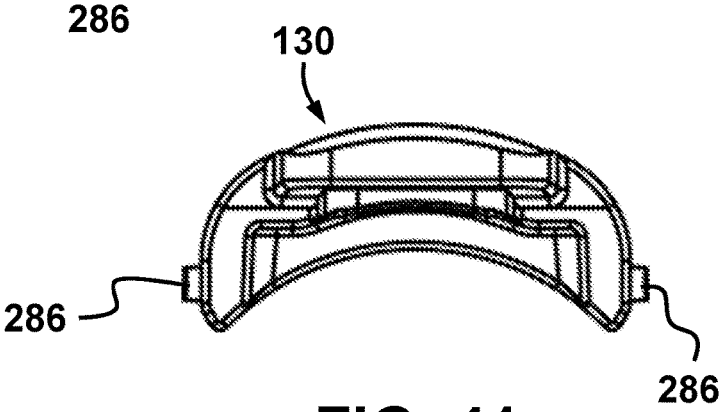
FIG. 41 is a front end view of the CRC device in FIG. 34.

FIG. 34 is an isometric view of the CRC device 130 shown in FIG. 1 from a first viewpoint. The CRC device 130 in FIG. 34 is also illustrated in FIGS. 35 to 41. FIGS. 35 to 41 are, respectively, an isometric view from a second viewpoint, a top view, a bottom view, a side view, a longitudinal cross section view, a rear end view and a front end view thereof. Other configurations and arrangements are possible as well.

The CRC device 130 of the illustrated example has substantially a H-shaped structure that generally includes a front section 272 and a rear section 274. All sections can be molded together to form a monolithic unitary part. It is made of a highly resistant and resilient material, such as a plastic material. The CRC device 130 cooperates with adjacent parts to lock and unlock the spout 100. Other materials, configurations and arrangements are possible.

The front section 272 of the illustrated CRC device 130 has U-shaped body that is configured and disposed to fit over the rear supporting element 212 of the first bottom protrusion 120 in a retaining engagement. The exact configuration and arrangement may be different in some implementations.

The rear section 274 includes a cantilever flap 276 and two opposite elongated rear side arms 278. These three parts are individually extending from the rear side of the front section 272. The cantilever flap 276 is oriented slightly upwards when no force is exerted thereon. It is shown in the figures essentially in the position it has when mounted in the spout 100 while the spout 100 is locked. The actual piece can be manufactured with a steeper angle so as to generate an increased spring force in the final assembly. In the illustrated example, one or more hooks 280 are provided at the rear edge of the cantilever flap 276. These hooks 280 cooperate with the front flange 220 of the second protrusion 200 to limit the outward position of the cantilever flap 276 in the assembled spout 100. The cantilever flap 276 includes a main pressing surface 282 on which the user can press inwards to unlock the CRC device 130. Other configurations and arrangements are possible.

Figure 42:
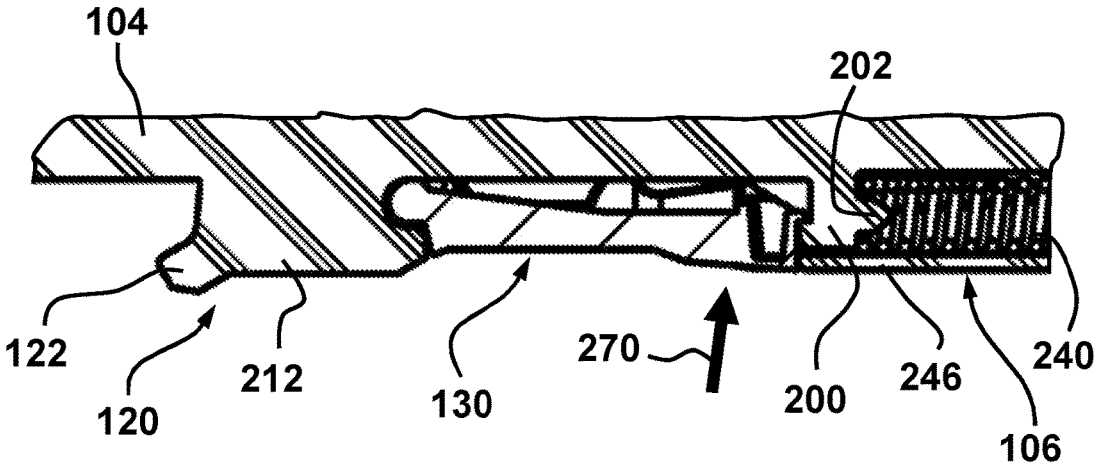
FIG. 42 is an enlarged longitudinal cross section view of the CRC device and nearby parts shown in FIG. 7.

FIG. 42 is an enlarged longitudinal cross section view of the CRC device 130 and nearby parts shown in FIG. 7. As can be seen, the CRC device 130 prevents the valve 140 from being open because the edge of the cantilever flap 276 abuts against the front end of the bottom wall 246. To unlock the CRC device 130, the user must push on the main surface 282 of the cantilever flap 276 with a force 270, thereby moving the cantilever flap 276 out of the way. The force is applied in a substantially radially inwards direction with reference to the spout 100. The CRC device 130 is designed so that the minimum force 270 required to move the cantilever flap 276 is beyond the physical capabilities of average children up to six years old. This can be done, for instance, by changing the angles and dimensions of the parts, their positioning relative to one another, the stiffness of the materials, etc. Other configurations and arrangements are possible as well.

In the illustrated example, at the position shown in FIG. 42, the free end of the two opposite rear side arms 278 of the CRC device 130 are urged slightly inwards. Pushing on the cantilever flap 276 with the force 270 will force the two lateral tabs 284 to slide inwards with the rest of the cantilever flap 276 but this requires the CRC device 130 to slide very slightly against the force from the biasing element, for instance the spring 240. This is what mainly generates the required force preventing young children from releasing the locking mechanism in the illustrated example. Then, once the cantilever flap 276 reaches its deflected position, it will not go back to the initial position for now because the two lateral tabs 284 are prevented from sliding back to their original position. The valve 140 can be opened when the user is ready.

As can be seen, each rear side arm 278 of the illustrated example includes an outer-facing lateral knob 286 positioned near the free end of each rear side arm 278. Each lateral knob 286 includes a front and a rear slanted surface. The lateral knobs 286 do not come out of the front end of the bottom conduit 124 regardless of the position of the valve 140. They are designed to engage corresponding lateral walls inside the bottom conduit 124. The transversal width of the bottom conduit 124, however, is slightly smaller than the transversal width between the lateral knobs 286 at their largest point. The engagement of the lateral knobs 286 with the inner lateral walls inside the bottom conduit 124 will thus force the rear side arms 278 to bend slightly inwards. The illustrated example further includes two opposite openings 288 made through the lateral walls inside the bottom conduit 124. These openings 288 are sized and shaped for receiving the lateral knobs 286, thereby allowing the rear side arms 278 to spread out. The openings 288 are positioned so that the lateral knobs 286 are received therein when the valve 140 is near the closed position. The front edge of the openings 288, however, is slightly offset so as to force the free ends of the rear side arms 278 slightly closer to one another when the CRC device 130 is at the fully closed position.

It should be noted that in use, the weight of the container 102 can be supported on the receptacle, for instance by engaging the trigger 122 over the rim of the opening of the receptacle. The weight of the container 102 will compensate, at least partially, the force required to keep the valve 140 opened while pouring. Furthermore, this can be done without touching the CRC device 130 after the spout 100 was unlocked since the actuation force is applied on the trigger 122. This mitigates the risks of inadvertently damaging the CRC device 130. The trigger 122 as configured and disposed in the illustrated example greatly facilitates handling since the container 102 can be held using only one hand. The same hand can be used to unlock the CRC device 130 and to control the position of the valve 140. The user can use the other hand to hold the recipient or for gripping a fixed object while pouring.

The valve 140 in the illustrated example will automatically close upon releasing the actuation force of the trigger 122. The biasing element, for instance the spring 240, will then urge the first member 104 to slide towards the front with reference to the second member 106. The cantilever flap 276 will eventually come out of the bottom conduit 124 and it is no longer held in the unlocked position since the valve 140 opened. As aforesaid, there are two opposite cut-out portions 248 and they allow the free end of the rear side arms 278 to be slightly further apart from one another since the lateral knobs 286 will not directly engage other surfaces. The two lateral tabs 284 are no longer held and the natural spring force generated by the material at the junction between the cantilever flap 276 and the rest of the CRC device 130 will urge the cantilever flap 276 to engage the inner surface of the bottom wall 246. This will not significantly interfere with the sliding motion of the first member 104 and once the cantilever flap 276 is out of the bottom conduit 124, it will no longer be in registry with it. The spout 100 will then be locked once again.

Figure 43:
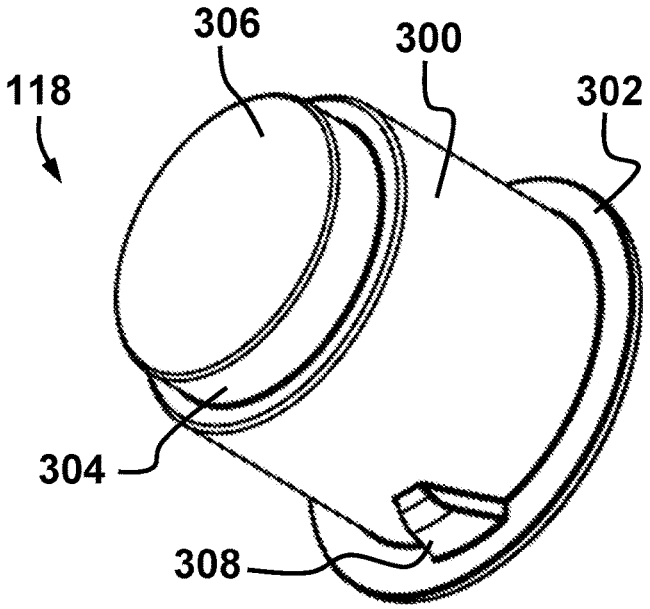
FIG. 43 is an isometric view of the cap shown in FIG. 5.
Figure 44:
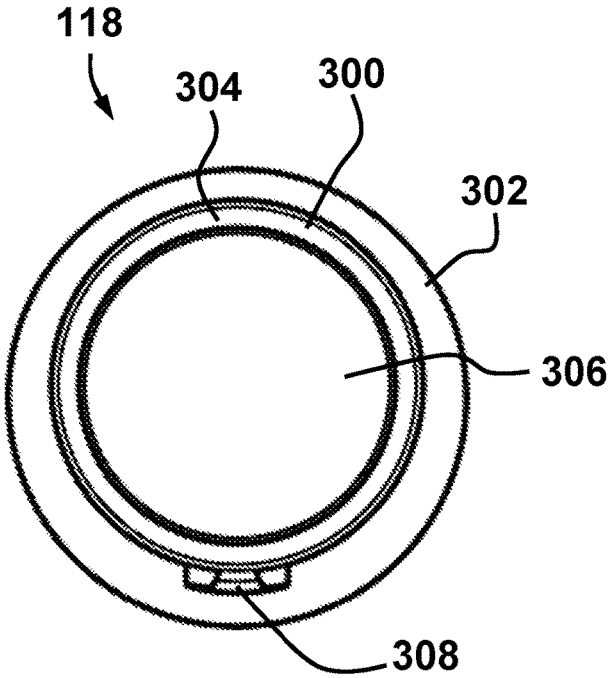
FIG. 44 is a front view of the cap in FIG. 43.
Figure 45:
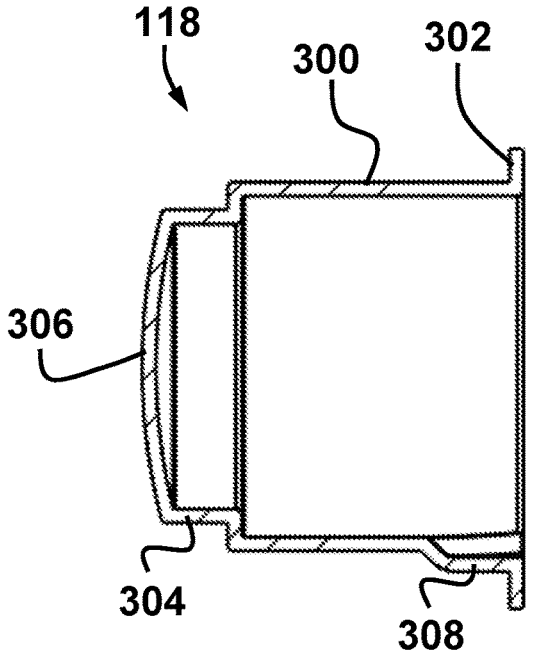
FIG. 45 is a longitudinal cross section view of the cap in FIG. 43.

FIG. 43 is an isometric view of the cap 118 in FIG. 5. FIG. 44 is a front view of the cap 118 shown in FIG. 43. FIG. 45 is a longitudinal cross section view thereof.

As can be seen, the cap 118 of the illustrated example includes a main body having a first tubular segment 300, a flange 302 surrounding the cavity inside the main body, a second tubular segment 304 that smaller in diameter than that of the first tubular segment 300, and an end wall 306. The illustrated cap 118 further includes a small bottom receptacle 308 creating an additional space within the cap 118 to receive a narrow reinforcing rib 310 extending longitudinally behind the outer rim portion 116 underneath the base 110, as shown in FIG. 9B. It is also visible in other figures, such as in FIGS. 31B, 32 and 33. Although this rib 310 is relatively short in length, the receptacle 308 compensates for its presence and maintain a tight fit. Other configurations and arrangements are possible. The receptacle 308 and the rib 310 can be omitted in some implementations.

As can be appreciated, the spout 100 as proposed herein can have, among other things, one or more the following advantages:

- the liquid output is maximized because of the smaller flow restrictions;
- the initial response time is very fast, and the liquid can start flowing fast almost immediately after opening the valve 140;
- the overall cross section area of the liquid passageway is maximized while the spout 100 can still fit inside the neck of the container 102, resulting in an increased flow during pouring;
- the base 110 of the spout 100 is located well inside the container 102 during the pouring;
- the valve 140 is located directly into the liquid when pouring;
- the spout 100 is reinforced when the intervening wall 148 is present;
- the flow is constant when pouring;
- the valve 140 is normally closed;
- the flow will automatically be decreased and then stopped when the spout tip 112 is immersed;

the CRC device 130 prevents a young child from accidentally opening it and spilling the liquid that is inside the container 102;

the CRC device 130 can be designed, as shown, to operate without any additional external spring;

the surfaces exposed to the liquid are minimized since no liquid can enter the air duct 142 when pouring and no liquid can enter the spout 100 when the valve 140 is closed;

the spout 100 can be stored outside or inside the container 102;

the container 102 can be held using a single hand when pouring;

the weight of the container 102 can be supported on the receptacle and this can also help control the position of the valve 140;

the actuation force to control the position of the valve 140 is not applied directly on the CRC device 130;

the number of plastic parts is minimal, for instance being only three in the illustrated example, plus the cap 118, the spring 240 and the three gaskets 160, 170, 230;

the same cap 118 can be used at two different locations on the spout 100.

The present detailed description and the appended figures are meant to be exemplary only, and a skilled person will recognize that variants can be made in light of a review of the present disclosure without departing from the proposed concept.

LIST OF REFERENCE NUMERALS

100 spout
102 liquid-storage container
104 first member
106 second member
110 base (of the spout)
112 tip (of the spout)
114 longitudinal axis
116 outer rim portion
118 cap
120 first bottom protrusion
122 trigger
124 bottom conduit
130 child-resistant closure (CRC) device
132 rear opening (of the spout)
134 first main body (of the first member)
136 front section (of the first main body)
138 rear section (of the first main body)
140 valve
142 air duct
143 liquid duct
144 first liquid duct portion
145 second liquid duct portion
146 V-shaped wall
148 intervening wall
150 second main body (of the second member)
152 inner conduit (of the second main body)
154 rear section (of the valve)
156 front section (of the valve)
158 rear-facing open cavity (of the valve)
160 valve gasket (O-ring)
162 valve seat
164 mounting groove (for valve gasket)
170 outer gasket (U-ring)
172 outer peripheral flange
180 constricted opening
182 plenum
184 top surface
190 lateral guiding element
192 flange
200 second bottom protrusion
202 mounting member
210 opening (adjacent the valve)
212 rear supporting element (of the first bottom protrusion)
220 front flange (on second bottom protrusion)
230 inner gasket (T-ring)
232 groove
234 projecting part (on the inner gasket)
240 biasing element/spring
242 lateral wall
246 bottom wall
248 cut-out portion
270 force (to unlock CRC device)
272 front section
274 rear section
276 cantilever flap
278 rear side arm
280 hook
282 main surface (of cantilever flap)
284 lateral tab
286 lateral knob
288 opening (through each lateral wall)
300 first tubular segment (of the cap)
302 flange (of the cap)
304 second tubular segment (of the cap)
306 end wall (of the cap)
308 receptacle (of the cap)
310 reinforcing rib

What is claimed is:

1. A vented pouring spout for a liquid-storage container, the spout including:

a first member including:

an elongated and generally tubular first main body having a front section and a rear section, the first main body having at least two longitudinally extending internal passageways, one being an air duct through which an air circuit passes when air enters the container and the other being a liquid duct through which a liquid circuit passes when the liquid flows out of the container, the air duct being generally positioned along a top side of the first main body and being smaller in cross section than that of the liquid duct, the air duct extending inside the first main body up to at least one constricted opening that is generally positioned at a rear end of the first main body and through which the air circuit exits the air duct, the air duct being segregated from the liquid duct; and a valve provided at the rear end of the first main body, the valve having a rear section and a front tapered section, the front tapered section extending between the rear section of the first main body and the rear section of the valve, the front section being adjacent to an inlet of the liquid duct and to the at least one constricted opening, with the front section being in front of an outlet of the constricted opening;

a second member including:

an elongated second main body having a straight tubular inner conduit inside which the rear section of the first main body is slidingly movable, the inner conduit having a rear end defining a valve seat that is engaged by the valve in a closed position to block the air circuit and the liquid circuit, the valve being out of engagement with the valve seat when the valve is in a fully opened position; and an outer rim portion projecting out from the second main body and being longitudinally spaced apart from the rear end of the inner conduit of the second main body, the outer rim portion delimiting a base of the spout from a forward section of the spout;

an inner gasket provided between the first member and the second member to seal in an airtight manner an intervening peripheral space between the rear section of the first main body and the inner conduit of the second main body when the valve is open; and a biasing element positioned between the first member and the second member to urge the valve towards the closed position.

2. The spout as defined in claim 1, wherein the liquid duct is subdivided in at least two liquid duct portions running parallel to one another and that are separated by an intervening wall, and the liquid duct portions have substantially identical cross section areas along the first member, the intervening wall being positioned along a medial axis of the first member.

3. The spout as defined in claim 1, wherein the liquid duct is substantially straight and substantially unobstructed along the entire first main body, the air duct being substantially straight and substantially unobstructed along the entire first main body up to the constricted opening.

4. The spout as defined in claim 1, wherein the rear section of the valve includes a valve gasket, the valve engaging the valve seat through the valve gasket.

5. The spout as defined in claim 1, wherein the front section of the valve is made integral with the rear section of the first main body.

6. The spout as defined in claim 1, wherein the outer rim portion includes an outer peripheral flange made integral with the second main body, and the outer rim portion includes an outer gasket mounted over the outer peripheral flange.

7. The spout as defined in claim 1, wherein the spout includes a child-resistant closure (CRC) device mounted between the first member and the second member, the CRC device having a locked position where the valve is prevented from moving out of the closed position, and an unlocked position where the first member is allowed to slide rearwards with reference to the second member, thereby opening the valve, and wherein the CRC device includes a main pressing surface for receiving a force applied in a substantially radially inwards direction to put the CRC device in an unlocked position, the CRC device being automatically reset back into the lock position once the first member is sled over a minimal distance with reference to the second member.

8. The spout as defined in claim 1, wherein the second member includes an elongated bottom conduit longitudinally extending underneath the second main body, the bottom conduit enclosing the biasing element, the biasing element including a compression helical spring.

9. The spout as defined in claim 1, wherein the inner gasket is mounted in an outer annular groove on the rear section of the first main body, the inner gasket having an inverted T-shaped cross-section.

10. The spout as defined in claim 1, wherein the spout further includes a protective cap engaging a tip of the spout with an interfering engagement.

11. The spout as defined in claim 1, wherein the front section of the valve includes a top surface positioned immediately adjacent to and spaced apart from the constricted opening, and the spout includes a plenum in which the air circuit enters when exiting the constricted opening, the plenum being located between the top surface of the valve and the constricted opening.

12. A vented pouring spout for a liquid-storage container, the spout generally extending along a longitudinal axis between a tip and a base, the spout having a rear opening on a rear side of the base, the spout including:

a first member having a front end corresponding to the tip of the spout, the first member including:

an elongated and generally tubular first main body having a front section and a rear section, the first main body having at least two longitudinally extending internal passageways, one being an air duct through which an air circuit passes when air enters the container and the other being a liquid duct through which a liquid circuit passes when the liquid flows out of the container, the air duct being generally positioned along a top side of the first main body and being smaller in cross section than that of the liquid duct, the air duct extending inside the first main body from the tip of the spout up to at least one constricted opening that is generally positioned at a rear end of the first main body and through which the air circuit exits the air duct; and a valve generally positioned substantially at a rearmost edge of the base, the valve having a rear section and a front tapered section, the front tapered section being made integral with the rear end of the first main body, the valve being selectively movable between a normally closed position and a fully opened position, the air duct being physically separated from the liquid duct along substantially the entire first main body;

a second member including:

an elongated second main body having a straight tubular inner conduit inside which the rear section of the first main body is slidingly movable, the first member being longer than the second member and at least a portion of the front section of the first member at the tip of the spout remaining outside the second member when the valve is in the fully opened position;

a valve seat provided at a rear end of the inner conduit of the second main body, the valve seat being located substantially within the rear opening of the spout and being engaged by the valve in the normally closed position to block the air circuit and the liquid circuit, the valve being out of engagement with the valve seat when the valve is in the fully opened position; and an outer rim portion radially projecting out around the second member and being spaced apart from the rear end of the base of the spout;

an inner gasket provided between the first member and the second member to seal in an airtight manner an intervening peripheral space between the rear section of the first main body and the inner conduit of the second main body when the valve is open; and a biasing element positioned between the first member and the second member to urge the valve towards the normally closed position.

13. The spout as defined in claim 12, wherein the liquid duct is subdivided in at least two liquid duct portions running parallel to one another and that are separated by an intervening wall, the liquid duct portions having substantially identical cross section areas along the first member, the intervening wall being positioned along a medial axis of the first member.

14. The spout as defined in claim 12, wherein the liquid duct is substantially straight and substantially unobstructed along the entire first main body, the air duct being substantially straight and substantially unobstructed along the entire first main body up to the constricted opening.

15. The spout as defined in claim 12, wherein the outer rim portion includes an outer peripheral flange made integral with and radially projecting from the second main body, and an outer gasket mounted over and covering the outer peripheral flange.

16. The spout as defined in claim 12, wherein the spout includes a child-resistant closure (CRC) device mounted between the first member and the second member, the CRC device having a locked position where the valve is prevented from moving out of the closed position, and an unlocked position where the first member is allowed to slide rearwards with reference to the second member, thereby opening the valve, the CRC device including a main pressing surface for receiving a force applied in a substantially radially inwards direction to put the CRC device in an unlocked position, the CRC device being automatically reset back into the lock position once the first member is sled over a minimal distance with reference to the second member.

17. A vented pouring spout for a liquid-storage container, the spout generally extending along a longitudinal axis, the spout including:

a first member including:

an elongated and generally tubular first main body having a front section and a rear section, the first main body having at least two longitudinally extending internal passageways, one being an air duct through which an air circuit passes when air enters the container and the other being a liquid duct through which a liquid circuit passes when the liquid flows out of the container, the air duct being generally positioned along a top side of the first main body and being smaller in cross section than that of the liquid duct, the air duct extending inside the first main body up to at least one constricted opening that is generally positioned at a rear end of the first main body and through which the air circuit exits the air duct, the air duct being segregated from the liquid duct inside the first main body, the constricted opening being configured and disposed so that the air circuit follows a path across the constricted opening that is substantially parallel to the longitudinal axis; and a valve provided at the rear end of the first main body, the valve having a rear section and a front tapered section, the front tapered section extending between the rear section of the first main body and the rear section of the valve, the front section being adjacent to an inlet of the liquid duct and to the at least one constricted opening, with the front section being in front of an outlet of the constricted opening; and a second member including:

an elongated second main body having a straight tubular inner conduit inside which the rear section of the first main body is slidingly movable, the inner conduit having a rear end defining a valve seat that is engaged by the valve in a closed position to block the air circuit and the liquid circuit, the valve being out of engagement with the valve seat when the valve is in a fully opened position; and an outer rim portion projecting out from the second main body and being spaced apart from the rear end of the inner conduit of the second main body, the outer rim portion delimiting a base of the spout from a forward section of the spout;

an inner gasket provided between the first member and the second member to seal in an airtight manner an intervening peripheral space between the rear section of the first main body and the inner conduit of the second main body when the valve is open; and a biasing element positioned between the first member and the second member to urge the valve towards the closed position.

18. The spout as defined in claim 17, wherein the constricted opening has a minimal cross section area that is from 40% to 70% smaller than that of the air duct.

19. The spout as defined in claim 17, wherein the spout includes a plenum in which the air circuit enters when exiting the constricted opening, the plenum being at a rear end of the air duct.

20. The spout as defined in claim 19, wherein the front section of the valve includes a top surface positioned immediately adjacent to and spaced apart from the constricted opening, the top surface being obliquely disposed and having a smoother surface finish compared to that of other parts of the spout.

* * * * *